US007971817B1

(12) United States Patent
Rossi, Jr.

(10) Patent No.: US 7,971,817 B1
(45) Date of Patent: Jul. 5, 2011

(54) COMPACT MOBILE CRUSHING AND SCREENING APPARATUS

(76) Inventor: Robert R. Rossi, Jr., Lancaster, SC (US)

( * ) Notice: Subject to any disclaimer, the term of this patent is extended or adjusted under 35 U.S.C. 154(b) by 0 days.

(21) Appl. No.: 12/399,390

(22) Filed: Mar. 6, 2009

(51) Int. Cl.
*B02C 21/02* (2006.01)

(52) U.S. Cl. ..... 241/101.74

(58) Field of Classification Search . 241/101.71–101.78
See application file for complete search history.

(56) References Cited

U.S. PATENT DOCUMENTS

| | | | | |
|---|---|---|---|---|
| 6,871,807 | B2 | 3/2005 | Rossi, Jr. | |
| 6,915,972 | B2 | 7/2005 | Rossi, Jr. | |
| 6,935,588 | B2 * | 8/2005 | Blair et al. | 241/101.76 |
| 7,048,344 | B2 | 5/2006 | Courtemanche | |
| 7,249,641 | B2 | 7/2007 | Dommert et al. | |

OTHER PUBLICATIONS http://web.archive.org/web/20050411033007/www.metsominerals.com/inetMinerals/mm_cr, Published Apr. 2005.

* cited by examiner

*Primary Examiner* — Mark Rosenbaum
(74) *Attorney, Agent, or Firm* — Dority & Manning, P.A.

(57) ABSTRACT

A compact mobile crushing and screening apparatus for disintegrating solid feedstock and further processing the disintegrated feedstock comprises a hopper, a feedstock feeder system, a pre-screen (aka dirt screen), a crushing mechanism with a feed inlet opening, at least one side conveyor, a discharge conveyor having a front elevating section, a magnet and a screening/separator all on one track mounted framework that is radio remote controlled. The track mounted framework of the compact mobile crushing and screening apparatus provides the skeleton of the entire apparatus. The compact mobile crushing and screening apparatus comprises a crusher frame that carries the crushing mechanism and is integrated into the framework, which is configured and disposed to support and strengthen the crusher frame and thus reduces the mass and overall weight of the crusher frame. The feed inlet opening is at least about 3.5 square feet, the weight of the overall apparatus is no more than about twenty tons and the ratio of the area of the feed inlet opening in square feet to the overall weight of the apparatus in tons is at least about 0.25.

26 Claims, 24 Drawing Sheets

COMPACT MOBILE CRUSHING AND SCREENING APPARATUS

CROSS-REFERENCE TO RELATED APPLICATIONS

The present application is related to but does not claim priority to U.S. application Ser. No. 12/396,331, filed Mar. 2, 2009, and lapsed provisional patent application Ser. No. 61/032,558 filed Feb. 29, 2008.

STATEMENT REGARDING FEDERALLY SPONSORED RESEARCH OR DEVELOPMENT

N/A

BACKGROUND OF THE INVENTION

A conventional crusher must have a frame of significant mass in order to withstand the day-to-day tasks of crushing the material that is fed into the inlet opening of the crusher. So bulky are conventional crushers that the costs of transporting one between the east and west coasts of the United States prohibits construction of such a machine on the opposite coast from where the potential buyer of the machine resides.

Most continuously fed crushers just bolt down and may have some items attached to them and weigh on the order of forty tons. So-called bucket crushers such as in commonly owned U.S. Pat. Nos. 6,915,972 and 6,871,807 are usually not continuously fed because they must interrupt processing the debris in order to scoop up debris in their bucket before that debris can be processed. The remote control, track, feeder, screen combo has been done. Conventionally, the crusher frame could stand alone and be mounted on a steel stand, portable chassis or track mounted frame. In Europe, there are several companies that have focused on similar concepts. However, such systems are too big to fit into a standard ocean shipping container without prohibitively costly disassembly. Moreover, the weight of such systems makes them costly to propel over land and relatively energy inefficient to operate. Additionally, such systems weigh about 30 tons, and the ratio of the area in square feet of their inlet openings of their crushing mechanisms to their weight in tons typically is less than 0.17.

BRIEF OBJECTS AND SUMMARY OF THE INVENTION

It is a basic object of the invention to provide a compact mobile crushing and screening system that is inexpensive, extraordinarily light in weight, easily transportable between job sites and highly mobile once on the job site and that can be utilized by nearly any contractor to recycle and process materials that otherwise would be sent off site to a dumping ground.

A principal object of the invention is to provide a compact mobile crushing and screening system that can be used for disintegrating solid feedstock and further processing the disintegrated feedstock for recycling as well as for processing aggregate.

A further principal object of the invention is to provide a compact mobile crushing and screening system wherein the ratio of the area of the feed opening of the crusher to the weight of the overall system is larger than that same ratio for conventional systems.

Another principal object of the present invention is to provide a compact mobile crushing and screening system that functions like a mini factory for disintegrating solid feedstock and further processing the disintegrated feedstock for recycling as well as for processing aggregate.

An additional principal object of the invention is to provide a compact mobile crushing and screening apparatus that is configured to fit into a standard ocean shipping container with minor disassembly.

A still further principal object of the invention is to provide a compact mobile crushing and screening apparatus that is configured to be self-propelled over land with less consumption of energy than conventional systems capable of comparable processing throughput.

A yet further principal object of the invention is to provide a compact mobile crushing and screening apparatus that is continuously fed by a low height feeder configured to transport solid feedstock to the feed inlet of the crusher for disintegrating.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a compact mobile crushing and screening apparatus that can be used for disintegrating solid feedstock and further processing the disintegrated feedstock is provided. The compact mobile crushing and screening apparatus of the present invention resembles a mini factory.

One presently preferred embodiment of the compact mobile crushing and screening apparatus for disintegrating solid feedstock and further processing the disintegrated feedstock comprises a skeleton framework, a jaw crushing mechanism carried by the skeleton framework and having a feed inlet opening and a discharge outlet. This embodiment includes a screening/separator that is carried by the skeleton framework. This embodiment further can include a discharge conveyor carried by the skeleton framework and configured and disposed to move to the screening/separator for processing by the screening/separator, disintegrated feedstock material that is dispensed from the discharge outlet of the jaw crushing mechanism during operation of the apparatus. Moreover, to this embodiment can be added one or more of the features described hereafter. And yet the weight of the overall apparatus is no more than twenty tons (40,000 pounds), and the ratio of the area of the feed inlet opening in square feet to the weight of the overall apparatus in tons is at least about 0.25. For example, this embodiment and other embodiments of the compact mobile crushing and screening apparatus desirably can be configured to be self-mobile, such as by having the skeleton framework carried on a track crawler apparatus or mounted on wheels. Alternatively, this embodiment and other embodiments also can be configured so that the skeleton framework is carried on skids for example or rests on a carriage such as a flat bed truck or rail car.

Another presently preferred embodiment of the compact mobile crushing and screening apparatus of the present invention desirably is radio remote controlled and includes all on one track mounted framework, a crushing mechanism and an inclined feed conveyor that moves feedstock material from a relatively low level above ground to a relatively higher level where the feedstock material can be provided to the inlet opening of the crushing mechanism. The compact mobile crushing and screening apparatus of the present invention desirably can include a hopper that receives the feedstock material to be processed before the feedstock material is moved by the inclined feed conveyor disposed partially beneath the hopper. The compact mobile crushing and screening apparatus of the present invention desirably can include a pre-screen (aka dirt screen) such as a scalping screen disposed between the relatively elevated end of the inclined feed conveyor and the crushing mechanism. The compact mobile crushing and screening apparatus of the present invention desirably can include a side conveyor disposed beneath the pre-screen. The compact mobile crushing and screening apparatus of the present invention desirably can include a discharge conveyor having an under crusher section disposed beneath the crushing mechanism. The discharge conveyor desirably can include an elevating front section aligned to receive processed material from the under crusher section of the discharge conveyor. The compact mobile crushing and screening apparatus of the present invention desirably can include a screening/separator disposed at the free end of the front section of the discharge conveyor. The compact mobile crushing and screening apparatus of the present invention desirably can include a screening/separator disposed beneath the free end of the front section of the discharge conveyor, and this screening/separator can have more than one deck. A first additional side conveyor and a second additional side conveyor can be carried by the skeleton framework and each additional side conveyor configured and disposed so as to receive material processed by the screening/separator to direct each differently sized stream of particulate material into any one of various stock piles or to further conveyors. The compact mobile crushing and screening apparatus of the present invention desirably can include a magnet disposed over the front section of the discharge conveyor. The compact mobile crushing and screening apparatus of the present invention desirably can include a forward-most conveyor that desirably can be carried under the screening/separator. This forward-most conveyor desirably is an under screen fines conveyor that is configured and disposed to direct to a separate pile of fines or to additional conveyors, the finest sized stream of particulate material passing through the screening/separator. Notwithstanding the full range of features that can be included in one of the presently preferred embodiments of the invention, the ratio of the area of the inlet opening of the crushing mechanism in square feet to the weight of the compact mobile crushing and screening apparatus in tons is at least about 0.25, and that ratio can be satisfied even when the crushing mechanism is a jaw crushing mechanism and the overall apparatus weighs up to about twenty tons.

The crushing mechanism can be a jaw crusher type or an impact crusher type. The compact mobile crushing and screening apparatus comprises a crusher frame that carries the crushing mechanism. The track mounted framework of the compact mobile crushing and screening apparatus can provide the skeleton of the entire crushing and screening apparatus. The crusher frame can be integrated into the framework, and thus the frame of the crusher does not need to stand alone. The framework can be configured and disposed to support and strengthen the crusher frame and thus permit a reduction of the volume occupied by and overall weight of the crusher frame that would be needed for a stand-alone, continuously fed crushing mechanism. In the compact mobile crushing and screening apparatus, the frame of the crusher can be braced and supported by the same framework that supports and surrounds the entire compact mobile crushing and screening apparatus.

The concept resembles the relationship of the roots on a large tree to the part of the tree above ground. By the roots being anchored in the ground, though the roots are lighter in weight and occupy less volume than the part of the tree above ground, the roots nonetheless provide the necessary stability and strength to support the much heavier and larger part of the tree above ground.

Using the framework that supports and surrounds the entire compact mobile crushing and screening apparatus to also brace and support the crusher frame is one way to facilitate the ability to mount in a relatively very light weight and volumetrically compact system, a crushing mechanism that has a relatively larger feed opening in other words, the ratio of the area of the opening of the inlet to the crushing mechanism to the weight of the overall apparatus is larger for the apparatus of the present invention than that same ratio if a conventional system were to be fitted with features like the various screening/separator, side conveyors, magnets, feeder system, discharge conveyor, etc. of the present invention. The compact mobile crushing and screening apparatus of the present invention can employ a structural concept that reduces weight and thus allows for easier transport and the ability to be shipped in a standard ocean container. Alternatively, lighter materials such as aluminum can be used for providing structural supports. The lighter the crushing mechanism, then the easier and less expensive it is to propel the crushing mechanism over land. The lighter weight compact mobile crushing and screening apparatus of the present invention enables fuel needed for its operation to be conserved and thus improves operating energy efficiency.

The weight lightening technique of utilizing the frame to strengthen the crusher frame as implemented in some embodiments of the compact mobile crushing and screening apparatus of the present invention is quite novel. This is especially true since the compact mobile crushing and screening apparatus of the present invention is capable of reducing the disintegrated feedstock down to one hundredth of the size of the input feedstock.

The accompanying drawings and color photos, which are incorporated in and constitute a part of this specification, illustrate at least one presently preferred embodiment of the invention as well as some alternative embodiments. These drawings and photos, together with the description, serve to explain the principles of the invention but by no means are intended to be exhaustive of all of the possible manifestations of the invention. It is to be noted that some of the photos were taken during assembly of a prototype of the compact mobile crusher and thus do not reflect the completed assembly.

DETAILED DESCRIPTION OF PRESENTLY PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
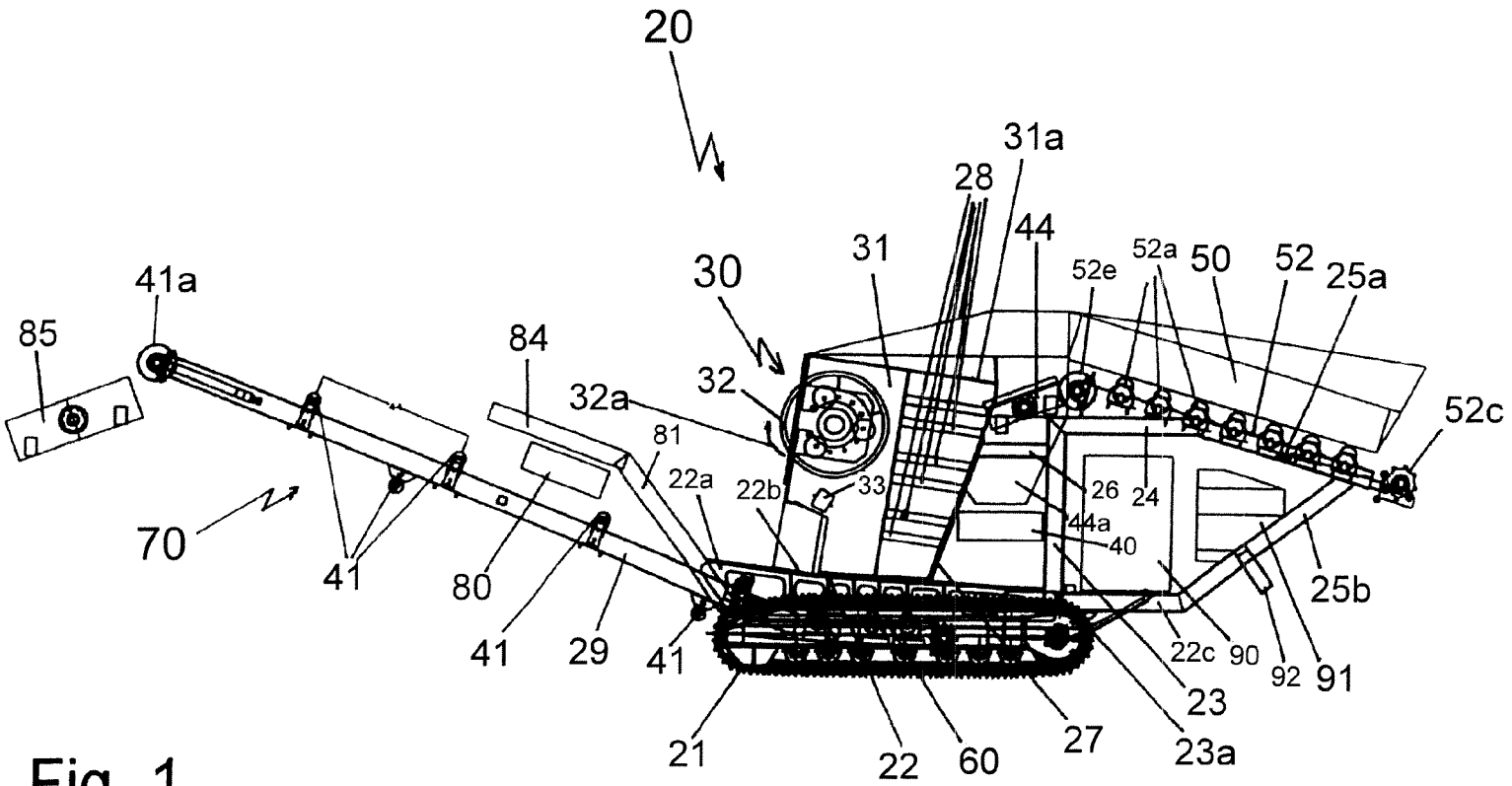
FIG. 1 is a schematic representation of an embodiment of the compact mobile crushing and screening apparatus of the present invention viewed from the left side with certain structures omitted in order to explain the relationships between other structures.
Figure 2A:
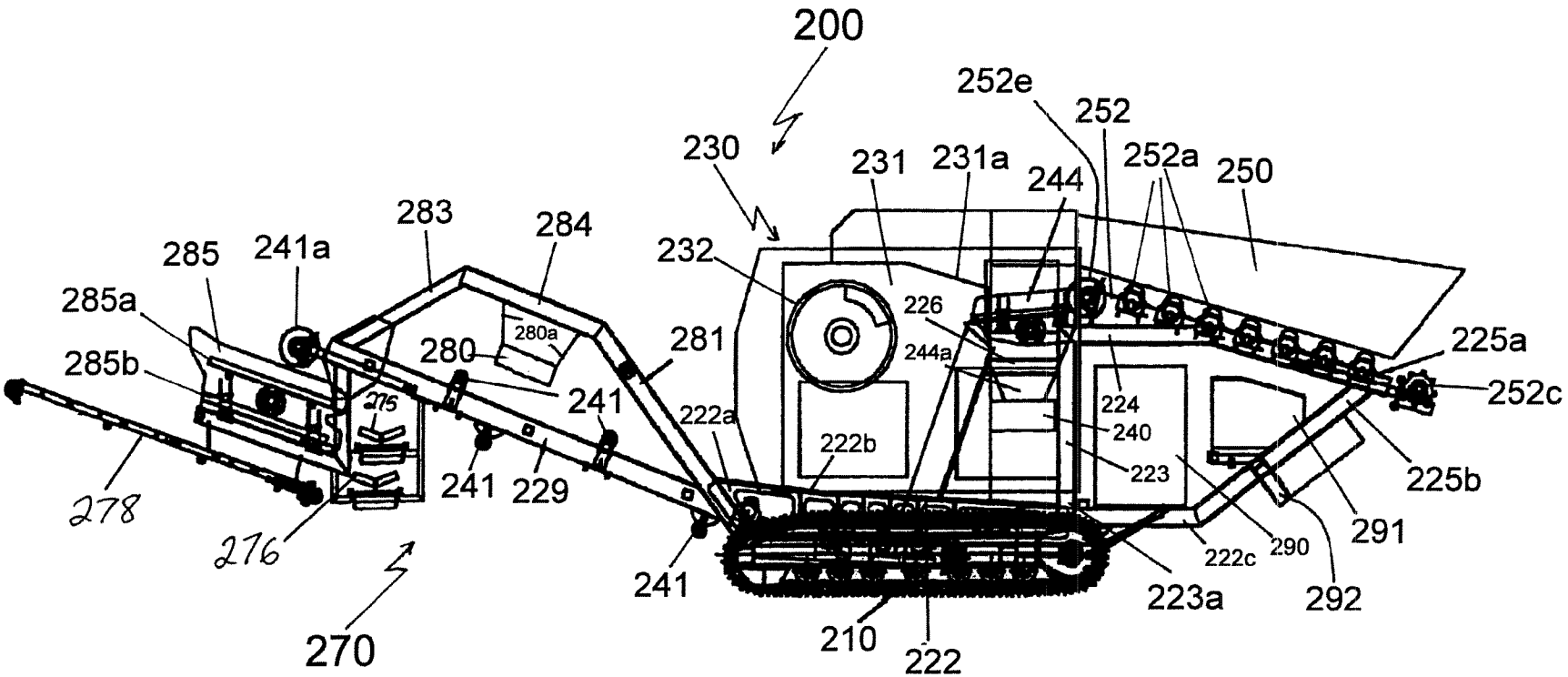
FIG. 2A is a schematic representation of an alternative embodiment of the compact mobile crushing and screening apparatus of the present invention viewed from the left side with certain structures omitted in order to explain the relationships between other structures.

Schematic representations of two presently preferred embodiments of the compact mobile crushing and screening apparatus are shown in FIGS. 1 and 2A and respectively are represented generally by the numerals 20 and 200. The compact mobile crushing and screening apparatus (aka compact mobile crusher 20 or 200) operates so as to disintegrate solid feedstock, which can be intermixed with dirt and/or sand, and further processes the disintegrated feedstock into distinctly differently sized solids. Each of FIGS. 1 and 2A presents a left side view of the schematic representation of a presently preferred embodiment of the compact mobile crushing and screening apparatus. Unless otherwise pointed out, the construction and arrangement of components of each alternative embodiment of FIGS. 1 and 2A can be the same.

Figure 4:
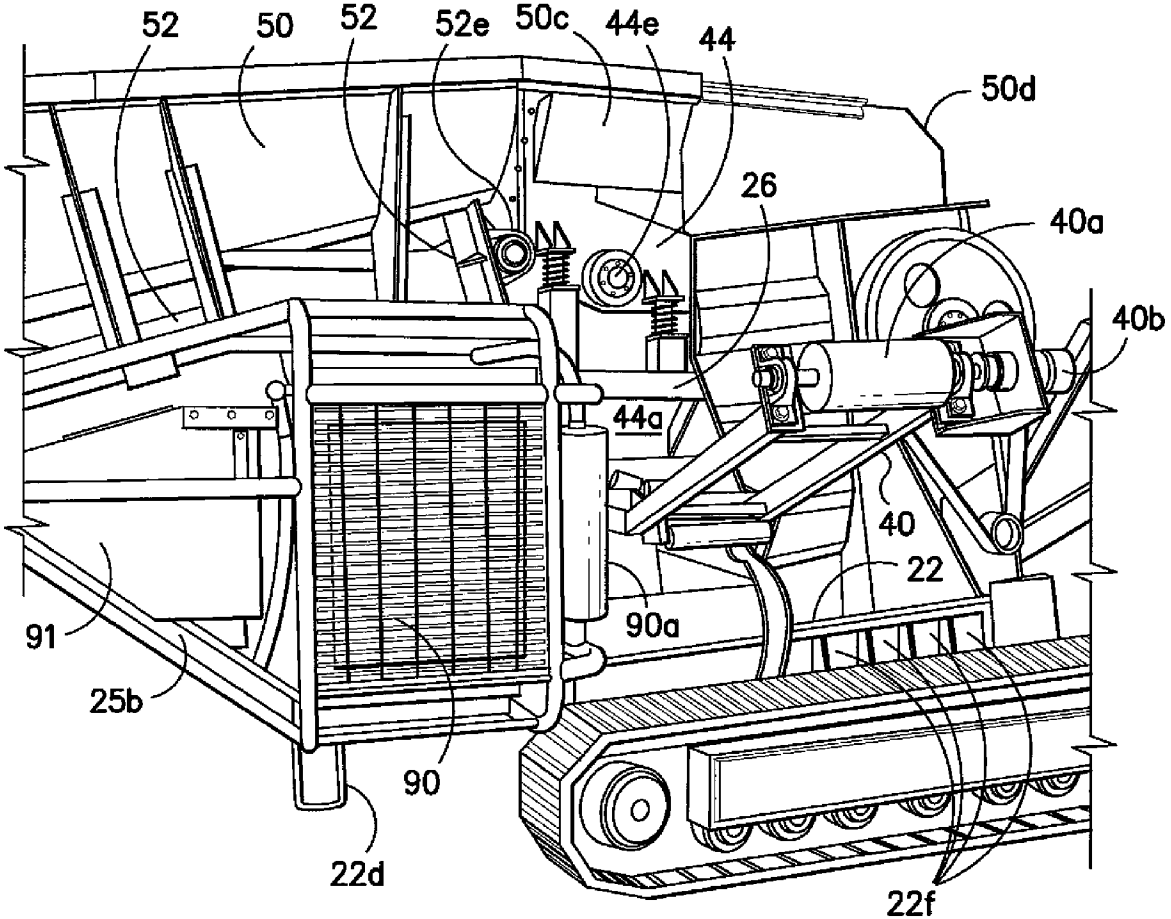
FIG. 4 is taken from the right side of a partially constructed prototype of an embodiment of the compact mobile crushing and screening apparatus.
Figure 8:
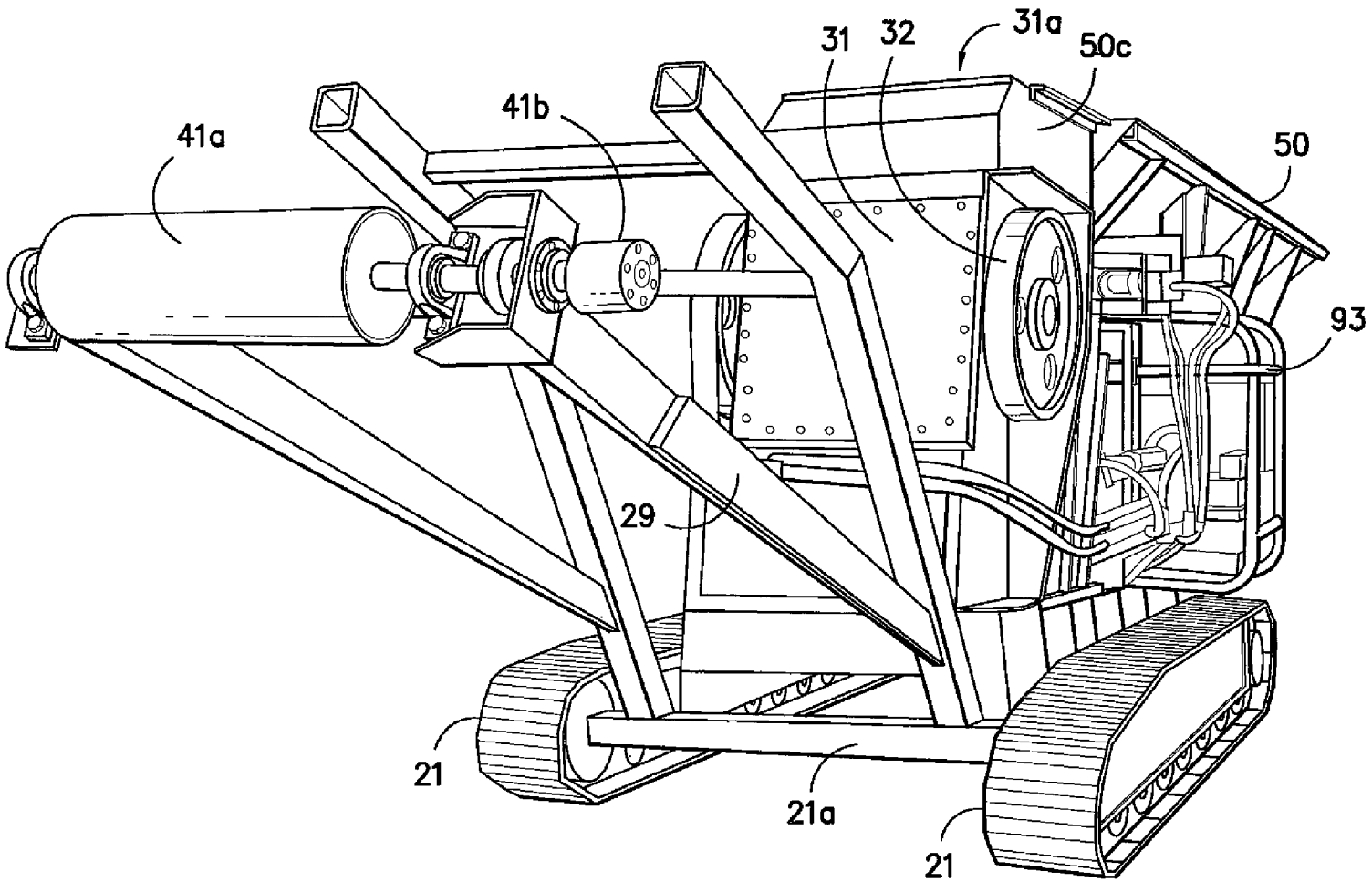
FIG. 8 is a perspective view taken from the front left side of a partially constructed prototype of an embodiment of the compact mobile crushing and screening apparatus.

The compact mobile crushing and screening apparatus desirably includes a pair of track mounted crawlers, one on each side of the compact mobile crushing and screening apparatus. As shown schematically in FIGS. 1 and 2A, there is a track crawler apparatus 21, 210 that engages the ground beneath the left side of the compact mobile crushing and screening apparatus. FIG. 4 is taken from the right side of the compact mobile crusher and shows the right track crawler apparatus 21 that engages the ground beneath the right side of the compact mobile crushing and screening apparatus. The mobile track crawler system includes a pair of track crawlers 21, 210 that are connected together and respectively carry the overall compact mobile crusher 20, 200, thereby providing auto-mobility to the compact mobile crusher 20, 200. As shown in FIG. 8, the forward axle 21*a* of the track crawler apparatus is disposed between the left track crawler apparatus 21 and the right track crawler apparatus 21.

The specific type of crawler traveling apparatus is not the focus of the present invention, and thus any of a number of different types of embodiments of crawler traveling apparatus can be provided as part of the compact mobile crusher 20. At least one example of a suitable crawler traveling apparatus is disclosed in U.S. Pat. No. 7,249,641, which is hereby incorporated herein for all purposes by this reference. Moreover, the compact mobile crushing and screening apparatus desirably can be configured to be self-mobile by having the skeleton framework carried on a chassis mounted on wheels. Alternatively, this embodiment and other embodiments also can be configured so that the skeleton framework is carried on skids for example or rests on a carriage such as a flat bed truck or rail car.

Figure 5:
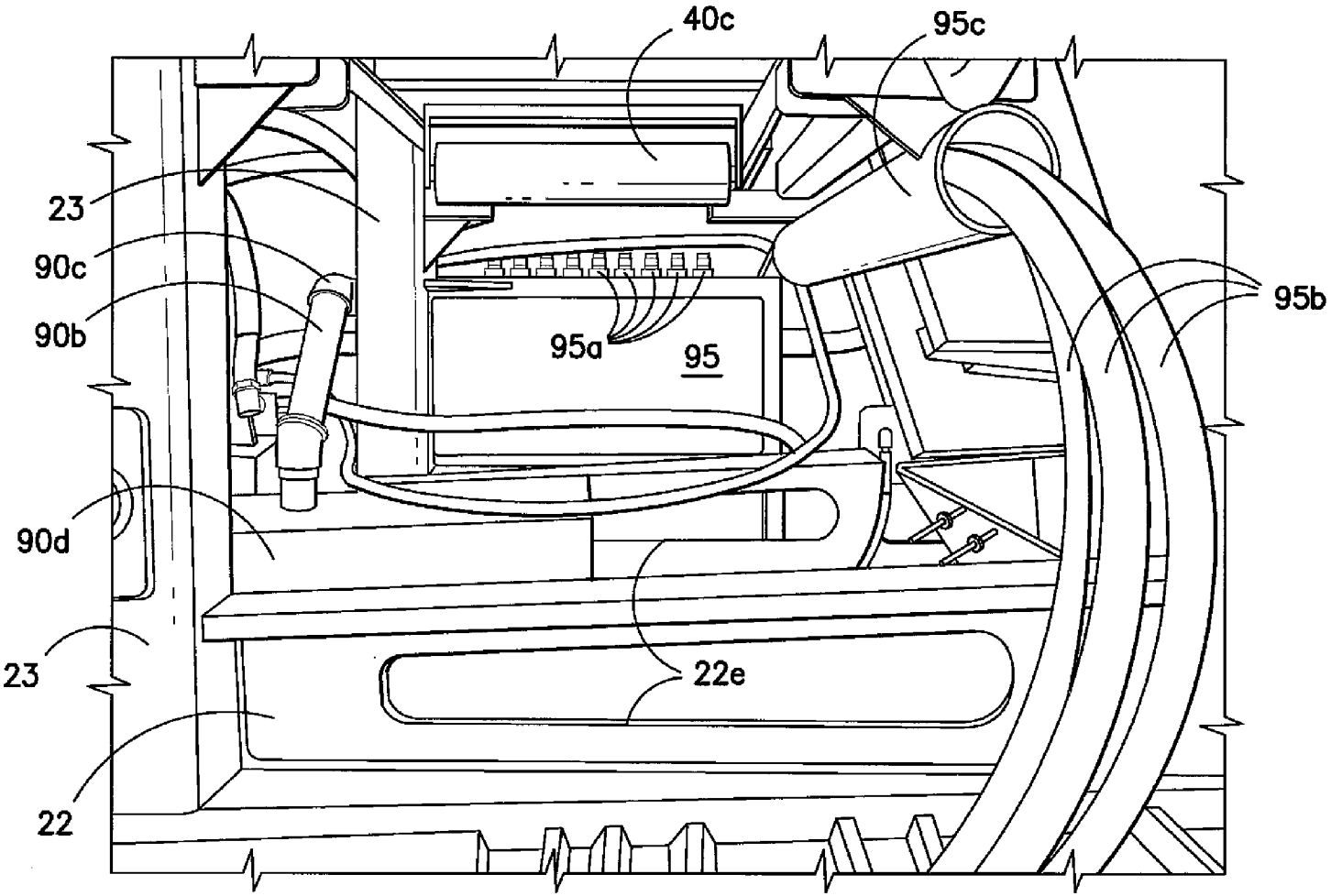
FIG. 5 is a side close-up view taken from the middle of the right side of a partially constructed prototype of an embodiment of the compact mobile crushing and screening apparatus.

As shown schematically in FIG. 1, the compact mobile crushing and screening apparatus can include a skeleton framework that anchors the overall compact mobile crushing and screening apparatus. The skeleton framework desirably can include a pair of base beams that extend from the front of the compact mobile crusher to the rear of the compact mobile crusher. Each base beam can be disposed spaced apart from and parallel to other base beam. One base beam can be disposed on the left side of the compact mobile crusher, and the other base beam can be disposed on the right side of the compact mobile crusher. As shown schematically in FIGS. 1 and 2A, the upper surface 22*b*, 222*b* of the forward end 22*a*, 222*a* of the left base beam 22, 222 gently slopes upwardly toward its forward end 22*a*, 222*a* at the front of the compact mobile crusher 20, 222. The right base beam 22 is similarly configured. As shown in FIG. 5, the base beams 22 are provided with elongated slots 22*e* that are configured to permit service access to the tail pulley of the discharge conveyor 60 that is disposed beneath the discharge outlet of the crusher housing 31 for the crushing mechanism.

As shown schematically in FIGS. 1 and 2A, the skeleton framework of each embodiment desirably includes a respective pair of stanchions 23, 223 disposed spaced apart from each other and parallel to each other. One stanchion is disposed on the left side of the compact mobile crusher, and the other stanchion is disposed on the right side of the compact mobile crusher. As shown schematically in FIGS. 1 and 2A, the base 23*a*, 223*a* of the left stanchion 23, 223 extends vertically upwardly from the left base beam 22, 222 of the compact mobile crusher 20, 200. The right stanchion 23 similarly extends vertically upwardly from the right base beam 22.

The skeleton framework desirably includes a pair of top beams disposed spaced apart from each other and parallel to each other. One top beam is disposed on the left side of the compact mobile crusher, and the other top beam is disposed on the right side of the compact mobile crusher. As shown schematically in FIGS. 1 and 2A, the left top beam 24, 224 extends horizontally from the left stanchion 23, 223 toward the rear of the compact mobile crusher 20, 200 and generally parallel to the rear portion 22*c*, 222*c* of the left base beam 22, 222. The right top beam 24 similarly extends horizontally from the right stanchion 23 toward the rear of the compact mobile crusher 20 and generally parallel to the rear portion 22*c* of the right base beam 22. The skeleton framework desirably includes an acute angled frame at the rear of the compact mobile crushing and screening apparatus. As shown in FIG. 1, when viewed from the left side, the rearmost portion of the skeleton framework tapers to an acutely angled pair of beams. As shown in FIGS. 1 and 2A, the rear end of the left upper leg 25*a*, 225*a* of the acutely angled pair of beams is joined to the rear end of the left lower leg 25*b*, 225*b* at an acute angle at the rear of the compact mobile crusher 20, 200. The forward end of the left upper leg 25*a*, 225*a* of the acutely angled pair of beams extends from the left top beam 24, 224. Similarly, the forward end of the left lower leg 25*b*, 225*b* of the acutely angled pair of beams extends from the rear end 22*c*, 222*c* of the left base beam 22, 222. The right side of the compact mobile crusher 20 is provided similarly, with an acutely angled pair of beams disposed spaced apart from the left acutely angled pair of beams 25*a*, 25*b* and 225*a*, 225*b* and parallel to the left acutely angled pair of beams 25*a*, 25*b* and 225*a*, 225*b*.

As shown schematically in FIGS. 1 and 2A, the respective upper leg 25*a*, 225*a* of the acute angled portion of the skeleton framework serves a dual purpose and function. The upper leg 25*a*, 225*a* of the acute angled portion of the skeleton framework supports and carries the main feedstock hopper 50, 250 that is angled slightly downwardly moving from forward to the rear of the compact mobile crusher 20, 200. The other function of the upper leg 25*a*, 225*a* of the acute angled portion of the skeleton framework is to provide the side mounting members for the idler rollers 52*a*, 252*a* of the feedstock conveyor 52, 252 that carries the feedstock from the feedstock hopper 50, 250 toward the crushing mechanism disposed at the front of the skeleton framework.

Figure 7:
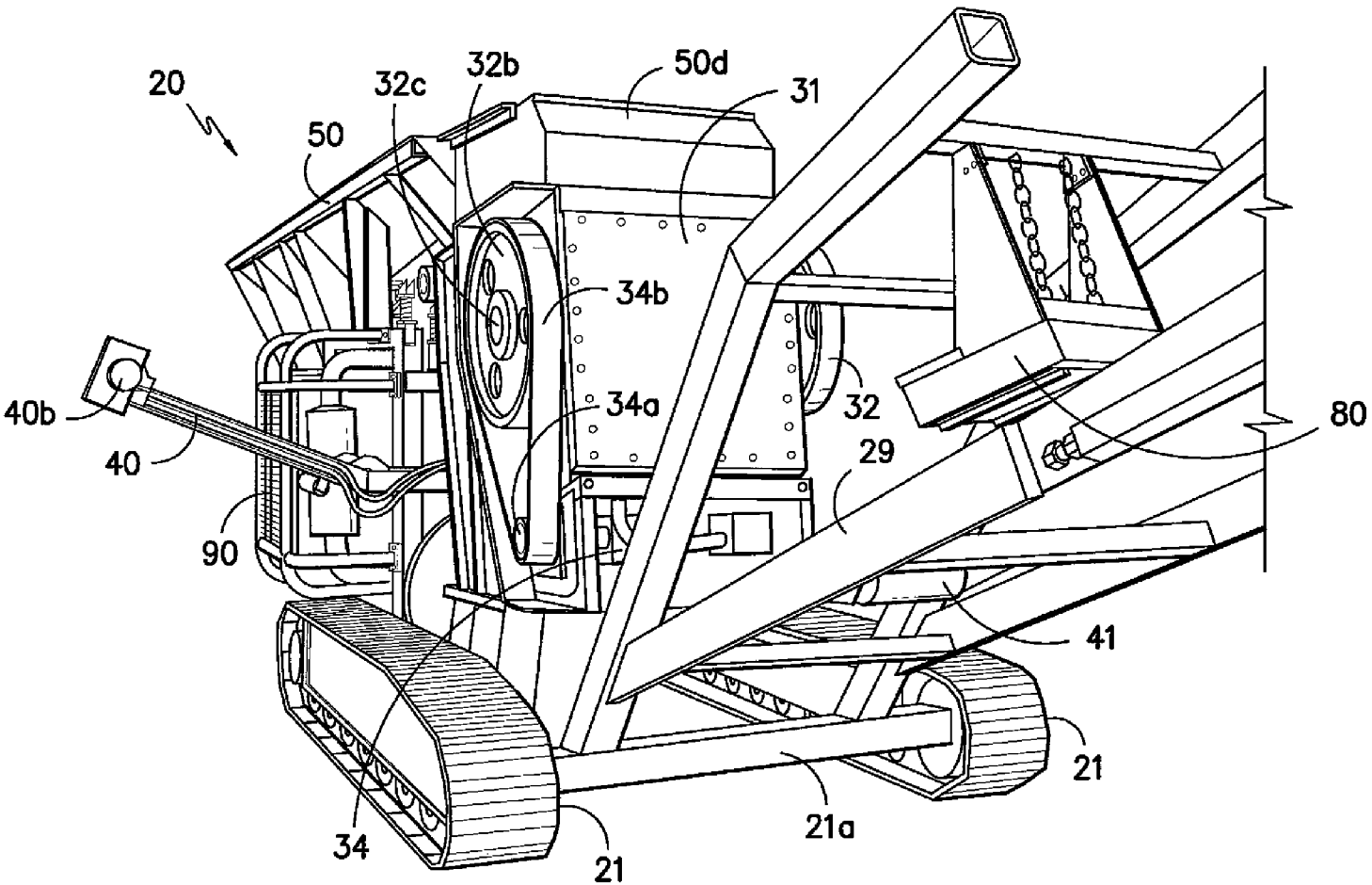
FIG. 7 shows a partially constructed prototype embodiment of the compact mobile crushing and screening apparatus in a perspective view taken from the front right side.

As shown schematically in FIGS. 1 and 2A, the compact mobile crusher 20, 200 includes a crushing mechanism that is designated generally by the numeral 30, 230. FIG. 7 shows a photo of a prototype of an embodiment of the compact mobile crusher 20 in a perspective view taken from the front right side of the compact mobile crusher 20. As shown in FIG. 7, the housing 31 that contains the crushing mechanism carries a drive mechanism, which desirably is connected to and driven by a hydraulic drive motor 34 for powering the moving parts in the crushing mechanism. As shown in FIG. 7, the hydraulic motor 34 rotates a drive pulley 34*a*, which drives a belt 34*b* that rotates a driven flywheel 32*b*, which is connected to the flywheel 32 by a common shaft 32*c*. As shown schematically in FIGS. 1 and 2A, the flywheel 32, 232 of the crushing mechanism 30, 230 is disposed externally of the housing 31, 231 for the crushing mechanism 30, 230. The direction of rotation of the flywheel 32, 232 is indicated in FIG. 1 by the direction in which the arrow 32*a* is pointing. However, the drive wheel 32 also can be rotated in reverse of the direction in which the arrow 32*a* is pointing, and thus the crushing mechanism 30, 230 can be driven in the reverse direction, which can be useful to clear the crushing mechanism if it becomes jammed.

Figure 1A:
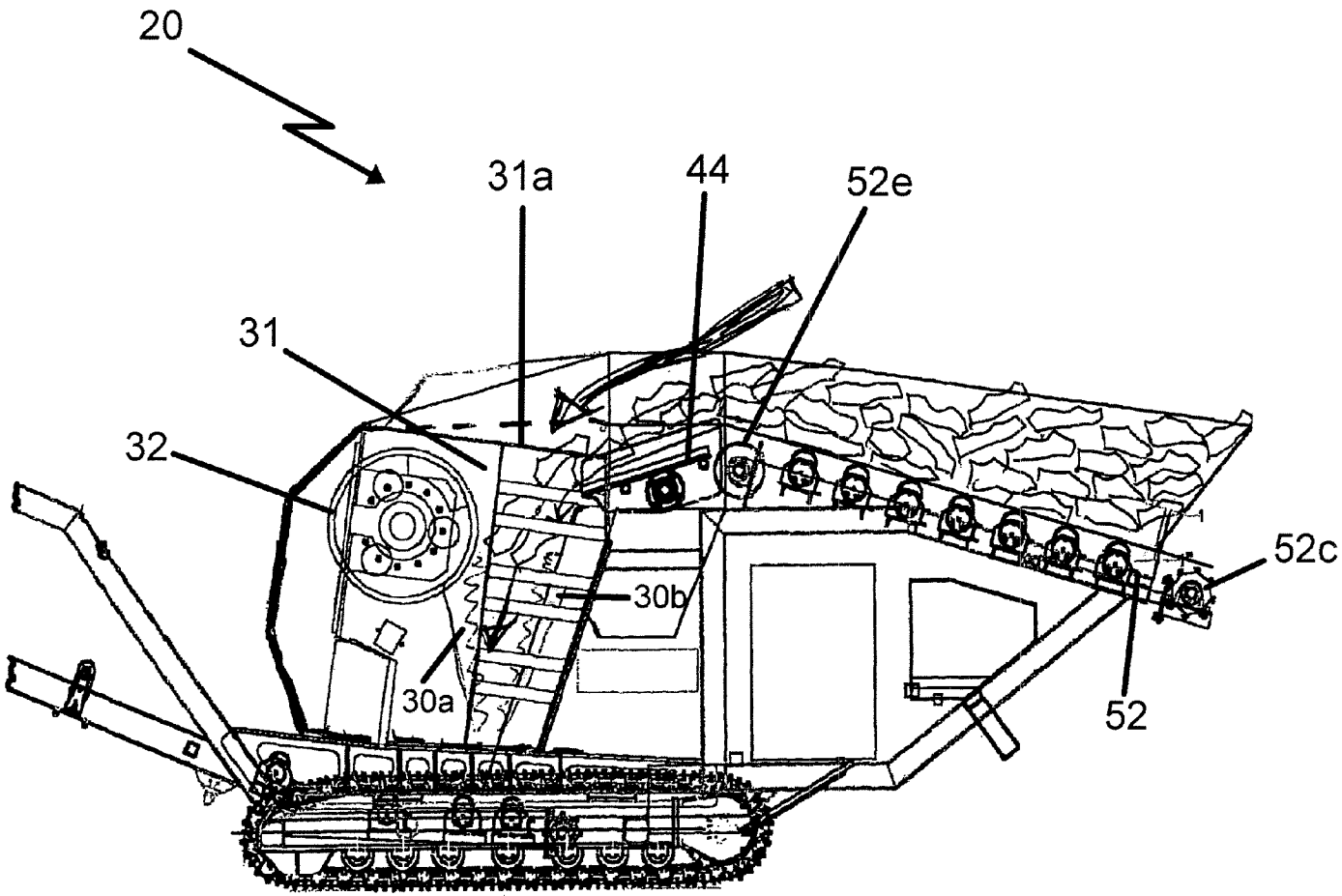
FIG. 1A is a schematic representation of parts of an embodiment of the compact mobile crushing and screening apparatus of the present invention viewed from the left side with certain structures omitted in order to explain the relationships between other structures.

The crushing implements of the crushing mechanism are disposed within the crusher frame 31, 231. For its part, the crushing mechanism is not shown in detail and can take numerous forms. For example, as schematically shown in FIG. 1A, the crushing mechanism 30 desirably is a jaw crusher and has a movable jaw 30*a* and a stationary jaw 30*b* disposed in opposition to the movable jaw 30*a*. Desirably, the movable jaw 30*a* is adjustable so that the gap between the jaws can be widened or narrowed to change the size of the particles that are discharged accordingly from the crushing mechanism. The size reduction in the feedstock to the jaw crusher desirably can be down to a maximum size of the particulates leaving the jaw crusher of about one cubic inch, which amounts to about one twenty-fifth of the size of the feedstock entering the jaw crusher.

Moreover, the crushing mechanism 30, 230 alternatively could be an impact crusher. Suitable crushing mechanisms are disclosed in commonly owned U.S. Pat. Nos. 6,915,972 and 6,871,807, which are hereby incorporated herein for all purposes by this reference. The moveable crushing implement is not visible in the view shown in each of FIGS. 1 and 2A and is behind the walls of the housing 31, 231, but the side in FIG. 1A has been partially removed to reveal the jaws 30*a*, 30*b*.

Figure 15:
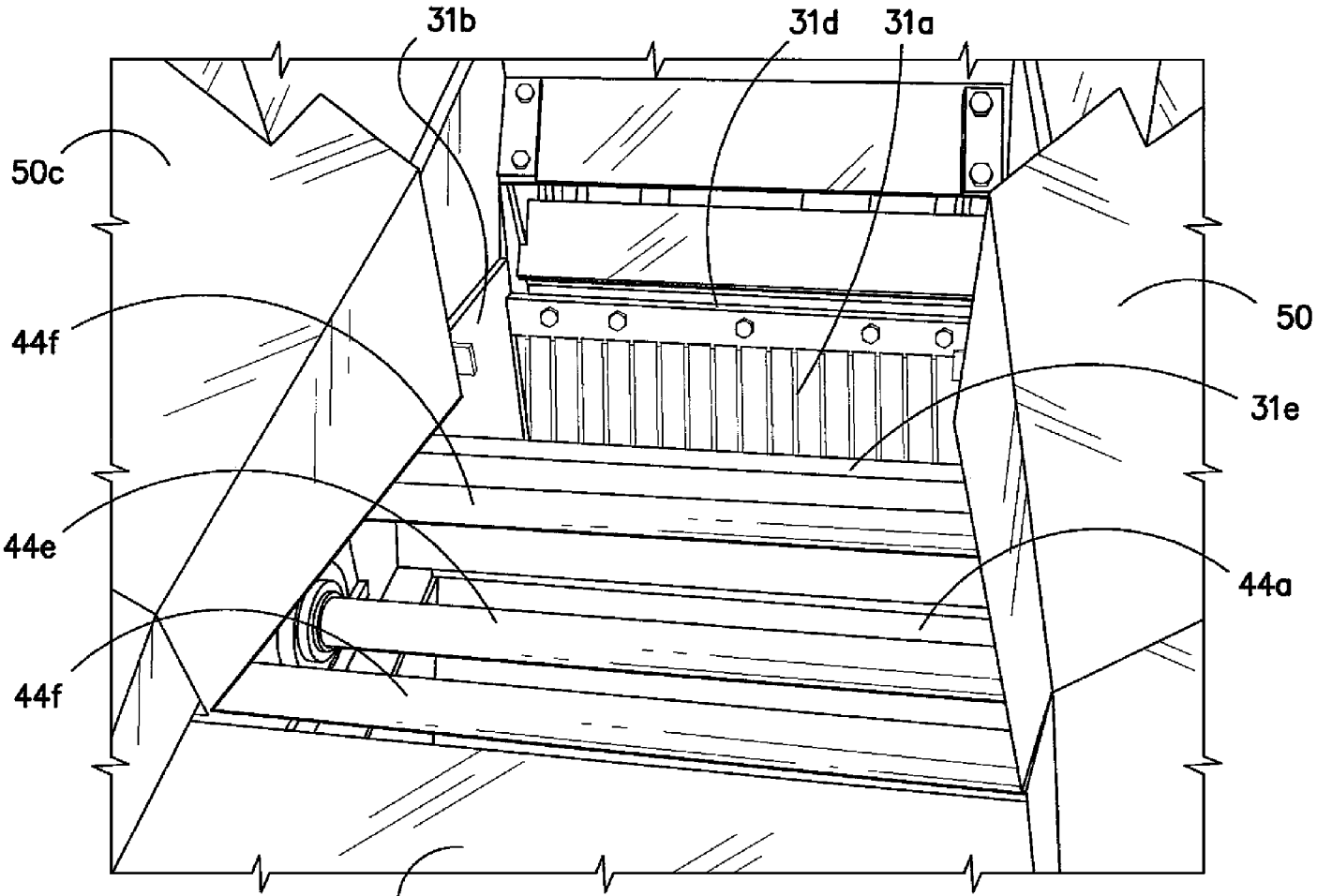
FIG. 15 is an elevated perspective view taken from the forward end of the inclined feedstock conveyor in the foreground and looking toward the feed inlet opening of the crusher housing of the crushing mechanism of an embodiment of the compact mobile crushing and screening apparatus.
Figure 16:
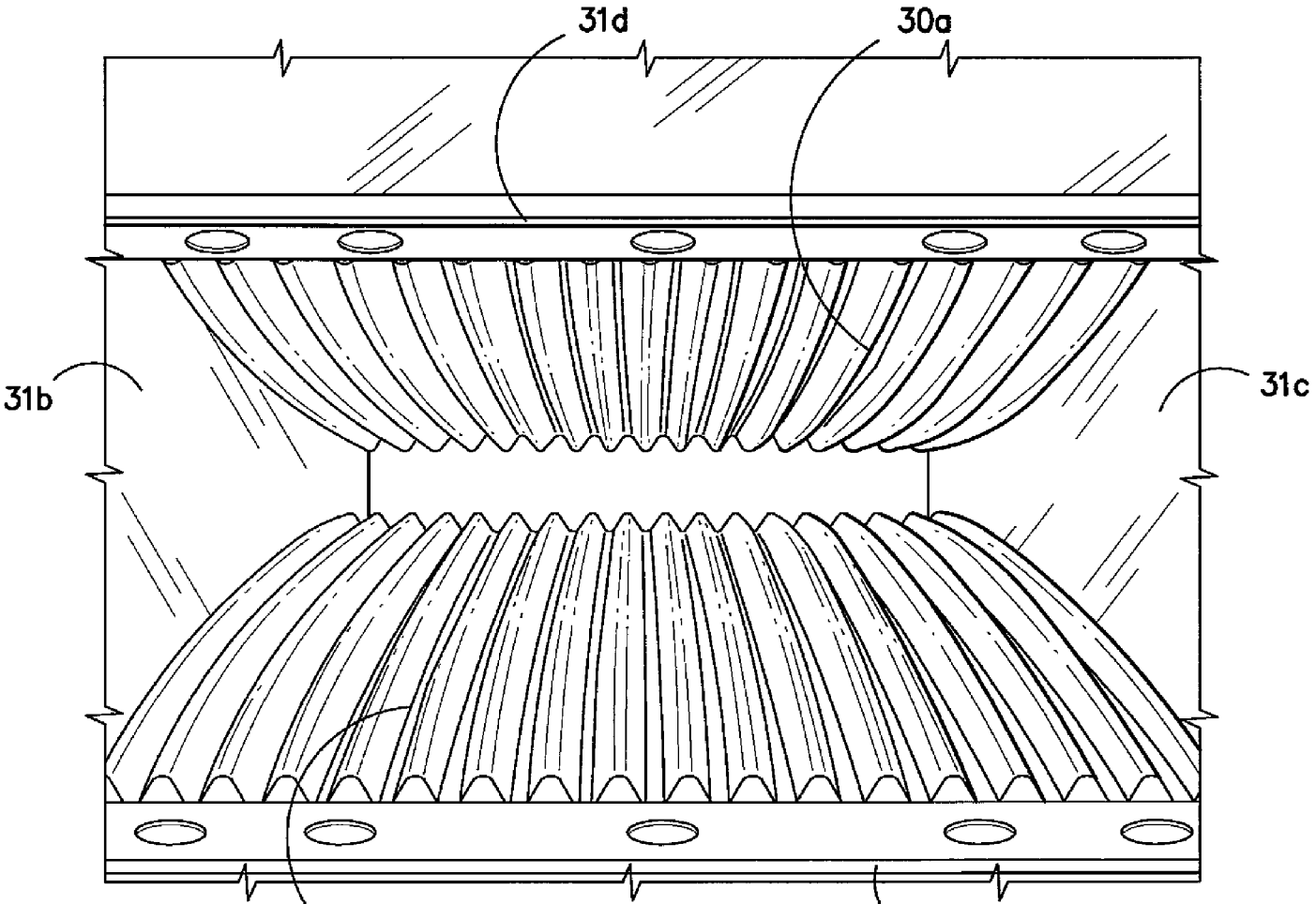
FIG. 16 is an elevated perspective view taken from directly above and looking down into the feed inlet opening defined in the top of the crusher housing of the crushing mechanism of an embodiment of the compact mobile crushing and screening apparatus.

As shown in FIG. 8, a feed inlet opening 31*a* for the crushing mechanism is formed in the top of the housing 31. FIG. 15 is an elevated perspective view with the forward end of the belt 52*b* of the inclined feedstock conveyor visible in the foreground and looking toward the feed inlet opening 31*a* of the crusher housing. As shown in FIG. 15, the feed inlet opening 31*a* of the crushing mechanism is defined by the upper edge of a left wall 31*b* and the upper edge of a right wall 31*c* (not visible in FIG. 15 but visible in FIG. 16). As shown in FIG. 15, the feed inlet opening 31*a* of the crushing mechanism is defined by an upper front edge 31*d* and an upper rear edge 31*e* of the crusher housing 31. As shown schematically in FIGS. 1 and 2A, the feed inlet opening 31*a*, 231*a* of the crushing mechanism disposed near the low side of the scalping screen 44 (described below), 244.

One unique feature of the compact mobile crushing and screening apparatus of the present invention is its relatively light weight with a relatively large feed inlet opening to the crushing mechanism. Conventional systems lack the combination of large feed inlet opening and low weight of the compact mobile crushing and screening apparatus of the present invention. The compact mobile crusher of the present invention also was configured with an overall volume so that with only minor disassembly the compact mobile crusher is capable of fitting into a standard ocean shipping container.

Figure 18:
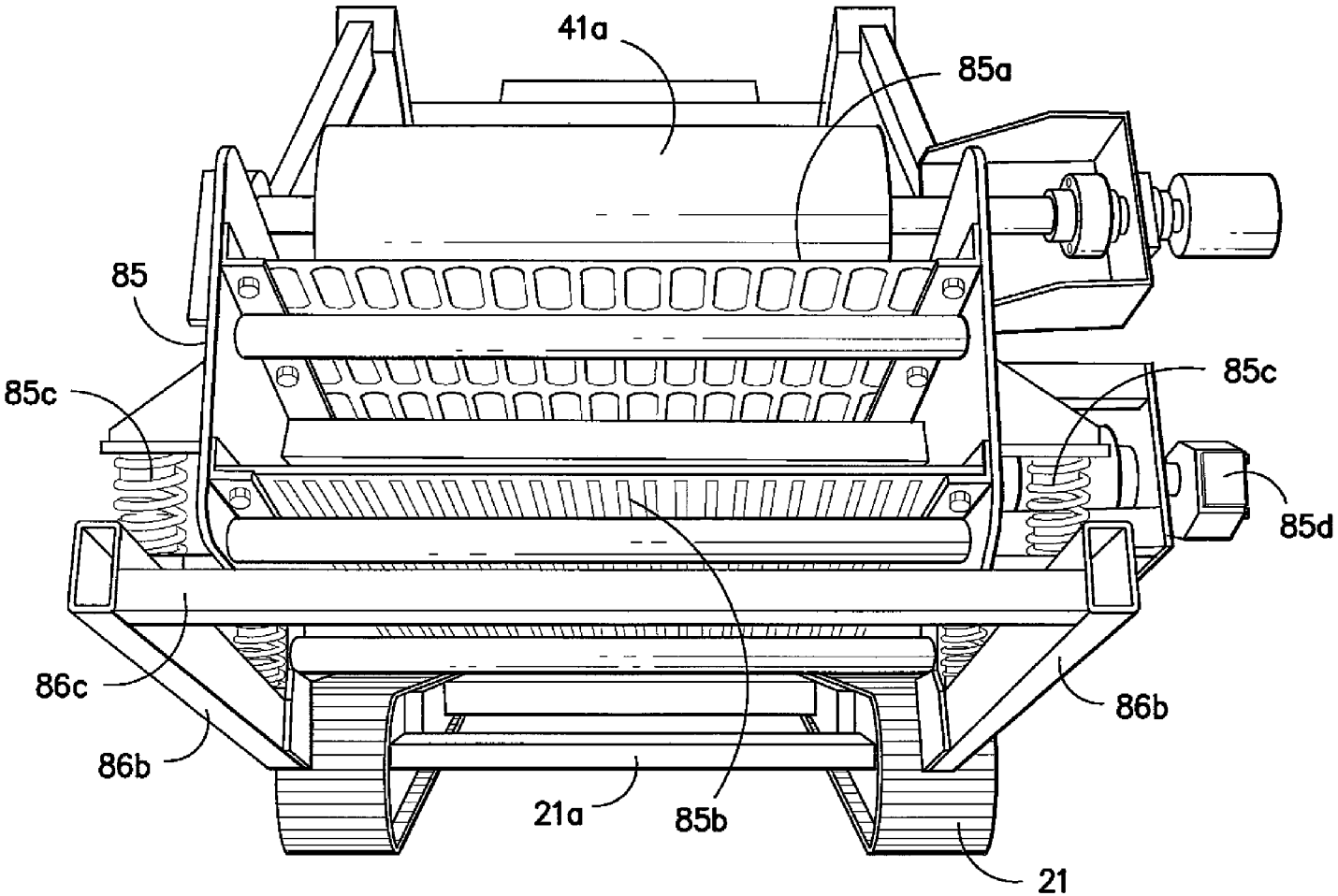
FIG. 18 is an elevated perspective view taken from directly in front of the end of the screening/separator carried by the forward structural frame of an embodiment of the compact mobile crushing and screening apparatus.

FIG. 18 is a view taken from directly above and looking down into the feed inlet opening 31*a* of the crushing mechanism with the left wall 31*b* of the crusher housing 31 opposed to the right wall 31*c* of the crusher housing 31. The width of the feed inlet opening 31*a* defined between the left wall 31*b* and the right wall 31*c* of the crusher housing 31 is desirably in a range of about 32 inches to about 52 inches. The length of the feed inlet opening 31*a* defined between the upper front edge 31*d* and the upper rear edge 31*e* of the crusher housing 31 is desirably in a range of about 16 inches to about 26 inches. Thus, the area of the feed inlet opening 31*a* is desirably in a range of about 3.5 square feet to about 9.4 square feet, and a feed inlet opening 31*a* of about 5 square feet is especially desirable as being large enough to accept most rock and demolition debris. In a presently preferred embodiment, each of the jaws 30*a*, 30*b* has a crushing surface that is about three feet long, and so given the area of the feed inlet opening 31*a* of between about 3.5 square feet and 9.4 square feet, the crushing chamber desirably has a volume of about 10.5 cubic feet to about 28.2 cubic feet.

The overall weight of the respective compact mobile crusher 20, 200 apparatus, even including all of the components mentioned herein and/or schematically shown in respective FIGS. 1 and 2A and in FIGS. 3 through 22 and outfitted in its fully operational finished product state, which additionally includes for example the painted outer skin (not shown) and all of the required safety guards (not shown), is desirably less than about 40,000 pounds or 20 tons and more desirably less than about 32,000 pounds or 16 tons and more desirably less than about 26,000 pounds or 13 tons. Yet the ratio of the area of the feed inlet opening in square feet to the overall weight of the compact mobile crusher 20, 200 in tons (area in square feet÷weight in tons) is at least about 0.25. For example 3.5 square feet÷13 tons=0.27 or 4 square feet÷16 tons=0.25 or 5 square feet÷20 tons=0.25 or 5 square feet÷13 tons=0.38 or 6 square feet÷16 tons=0.38 or 6 square feet÷20 tons=0.30 or 7 square feet÷18 tons=0.39 or 8 square feet÷20 tons=0.40 or 9.4 square feet÷20 tons=0.47.

Figure 21:
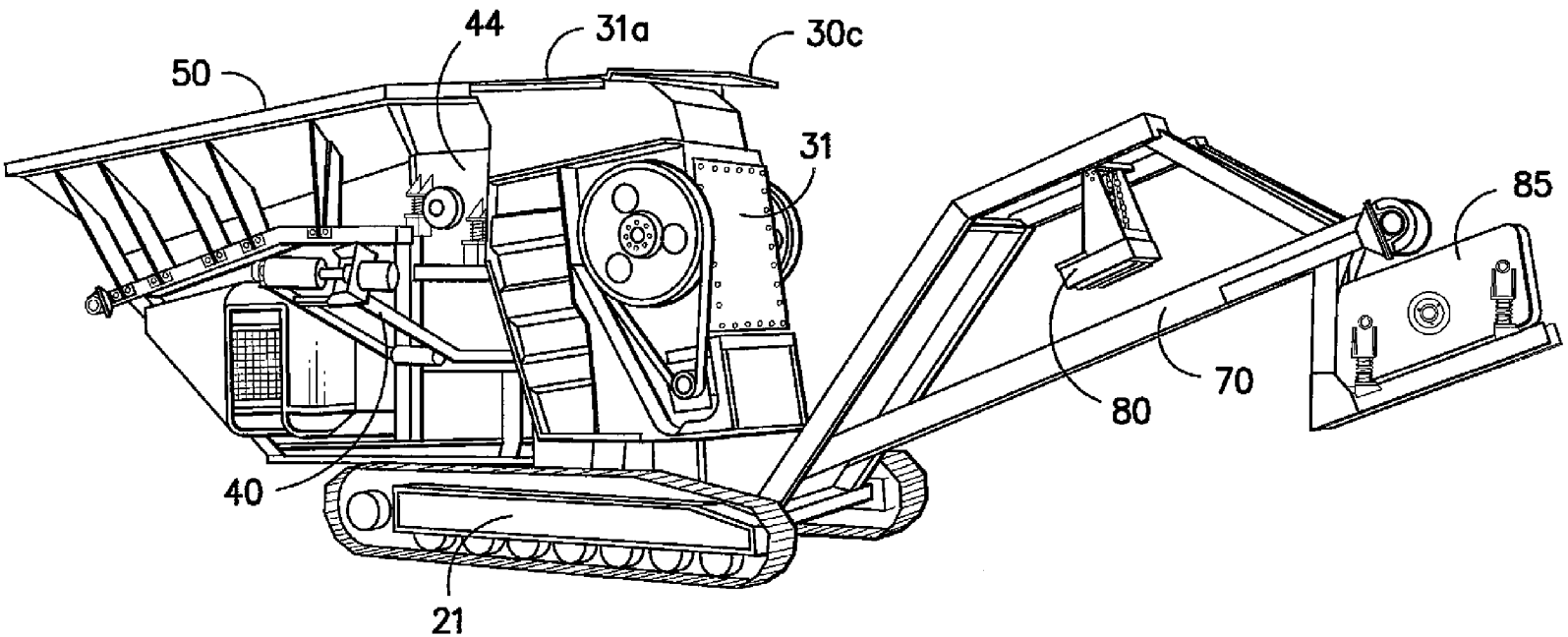
FIG. 21 is an elevated perspective view taken from the right side of a prototype of an embodiment of the compact mobile crushing and screening apparatus of the present invention.

As shown schematically in FIG. 4, a removable feed box 50*d* can be installed over the feed inlet opening of the crushing mechanism, which in this particular embodiment is a jaw crusher, but could be an impact crusher. The feed box 50*d* over the crushing mechanism also has a pivotable cover that is hinged at the front edge of the feed opening of the crushing mechanism in order to allow access to clear the chamber of the crushing mechanism without having to uninstall and remove the feed box 50*d*. As shown in FIG. 21, the crushing mechanism 30 can be top-loaded by lifting the hinged cover 30*c* that in the closed position would cover the feed inlet opening 31*a* beneath the feed box 50*d* that is removably connected to the crusher housing 31 over the crushing mechanism.

The compact mobile crushing and screening apparatus 20 includes a crusher frame 31 that is integrated into the skeleton framework. As shown schematically in FIGS. 1 and 2A, the skeleton framework is configured and disposed to support and strengthen the crusher housing 31, 231 and thus reduces the mass of the crushing mechanism 30, 230. The manner of accomplishing the integration of the crusher frame 31, 231 into the skeleton framework requires that substantially horizontally extending beams of the skeleton framework be disposed so as to counteract the substantially horizontally directed components of the forces generated by operation of the crushing mechanism 30, 230.

As schematically shown in FIGS. 1, 1A and 2A, the crushing mechanism is provided with a flywheel 32, 232 that stores inertial energy and provides additional crushing power during operation of the crushing implement. As schematically shown in FIG. 1A, the inertial energy stored in the flywheel 32 of the crushing mechanism 30 is transferred to the moveable crushing implement such as the moveable jaw 30*a* of a jaw crusher, during the crushing motion of the crushing mechanism 30.

In the view shown in FIG. 1, the moveable jaw would strike the feedstock as the flywheel 32 was rotating clockwise 32*a*. When the striking blow of the moveable crushing implement occurs as the flywheel is at the 3 o'clock position, the crushing forces are counteracted and thus absorbed by the substantial base beams 22. When the striking blow of the moveable crushing implement occurs as the flywheel is at the 9 o'clock position, the crushing forces are counteracted and thus absorbed by the substantial weight of the compact mobile crusher 20 and the feedstock being crushed. However, in the embodiment shown, due to the way that the crushing mechanism 30 is oriented with respect to the skeleton framework, when the striking blow of the moveable crushing implement occurs as the flywheel is at the 12 o'clock position or at the 6 o'clock position, the crushing forces that need to be absorbed are the forces directed from the front of the compact mobile crusher 20 to the rear of the compact mobile crusher 20 and vice versa. In a conventional stand-alone crushing mechanism, the crusher frame would need to be very heavily braced in order to counteract just such operational crushing forces.

Figure 10:
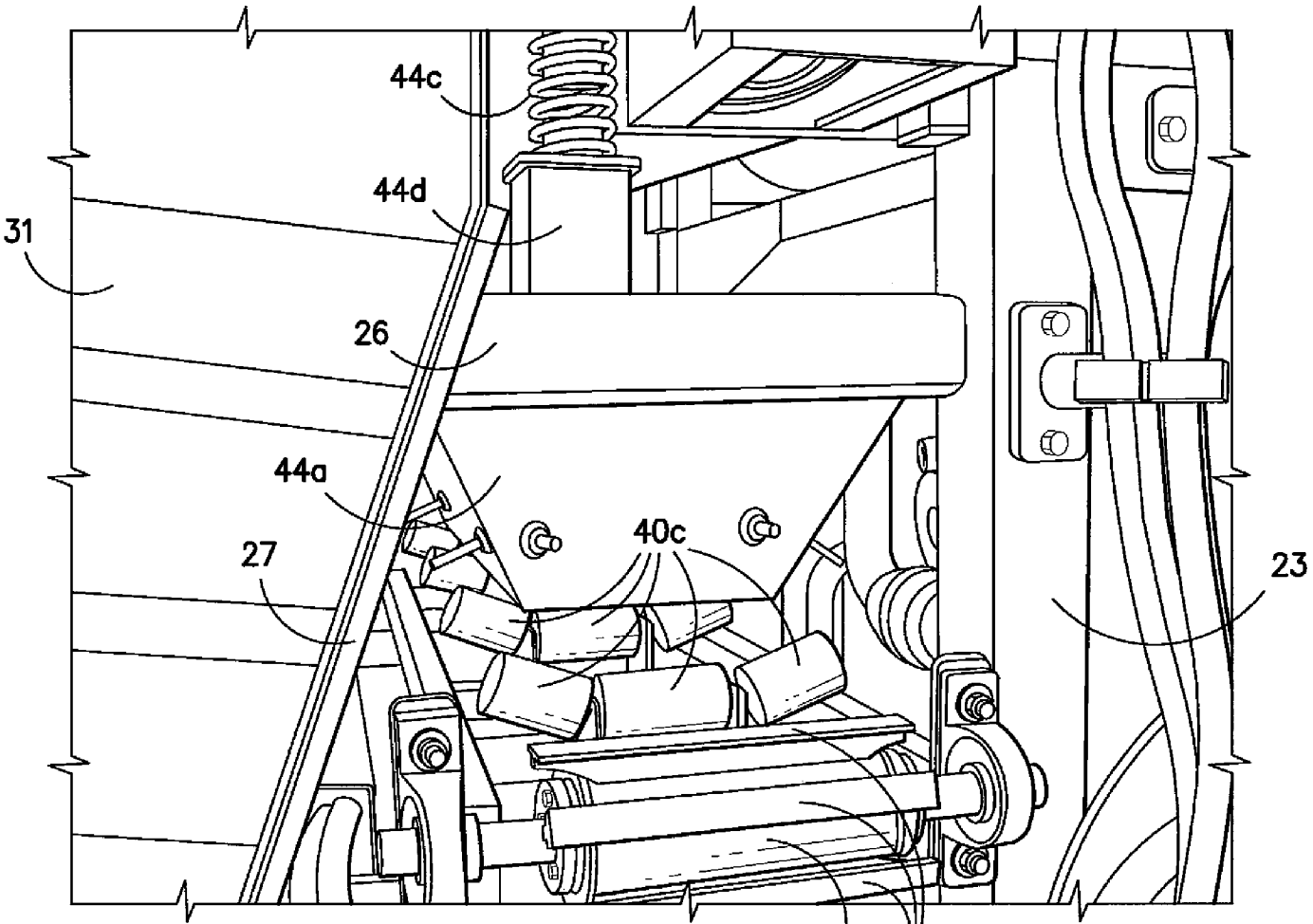
FIG. 10 shows a close-up view of part of the middle of the left side of a partially constructed prototype of an embodiment of the compact mobile crushing and screening apparatus.
Figure 11:
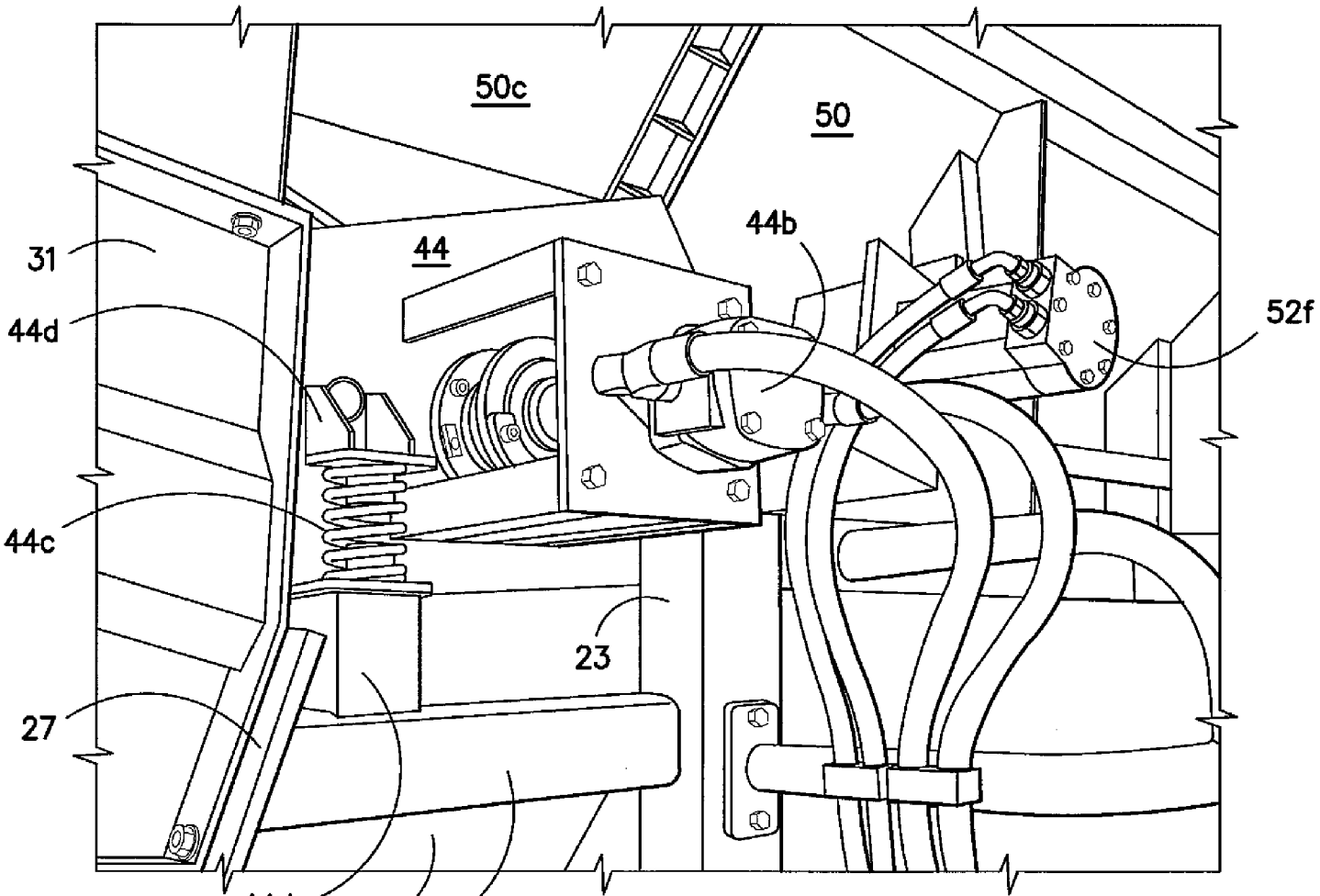
FIG. 11 is a close-up view of part of the middle of the left side of a partially constructed prototype of an embodiment of the compact mobile crushing and screening apparatus.

As noted above, operation of the crushing mechanism 30 of the compact mobile crusher 20 results in forces having a component directed in the horizontal direction between the front and rear of the compact mobile crusher 20. As shown in FIGS. 1 and 2A and FIG. 10 for example, these forces are absorbed by the configuration of the skeleton framework of the compact mobile crusher 20, 200. As shown in FIG. 1 and FIG. 10, a left horizontal support beam 26 spans between the left stanchion 23 and the rearwardly angled bulkhead 27 to which the housing 31 for the crushing mechanism 30 is braced by a plurality of upwardly angled braces 28. As shown in FIG. 11, the upper end of rearwardly angled bulkhead 27 is horizontally supported by the forward end of the horizontal support beam 26. The rearwardly angled bulkhead 27 desirably diverges by an acute angle of about ten degrees from the vertical. Each brace 28 is angled slightly above horizontal by about ten degrees. Moreover, upper leg 25*a* and lower leg 25*b* of the acutely angled pair of beams direct the forces from the horizontal support beam 26 to a common point. In this way, the unique configuration of the skeleton framework of the compact mobile crusher 20, 200 and the disposition of the crushing mechanism 30, 230 relative to the skeleton framework reinforces and supports the housing 31, 231 of the crushing mechanism 30, 230 and permits the use of a housing 31, 231 that is much lighter in weight and smaller in volume than a conventional housing for a convention stand-alone crusher.

As schematically shown in FIG. 1 for example, the crusher housing 31 desirably is provided with a door 33 that provides access inside the crusher housing 31 and particularly so as to install and or adjust shims. The small plate forming the door 33 is removable. By shimming the movable jaw die in a jaw crusher for example, the shim brings the jaws closer together and allows a closer discharge setting without adversely affecting the operation of the jaw. The shim just tightens the closed side setting. The shims adjust the jaw crusher for smaller or larger discharge settings. More shims make the jaw crush the feedstock into smaller sized pieces. Fewer shims open the crusher's discharge setting and thus make the jaw crush the feedstock into larger sized pieces in the final product. As alternatives to shims, the discharge setting of the crushing mechanism can be either controlled hydraulically or with a hydraulically assisted control mechanism.

Feedstock Hopper

As shown schematically in FIGS. 1 and 2A, the compact mobile crusher 20, 200 desirably can include a feedstock hopper 50, 250 carried by the top beams 24, 224 of the skeleton framework. The feedstock hopper 50, 250 functions essentially as a funnel for the feedstock that is to be processed. The top of the feedstock hopper 50, 250 has an inlet opening with a larger flow area than the size of the outlet opening at the bottom of the hopper. The side walls of the feedstock hopper 50, 250 taper from the inlet to the outlet. As shown in FIG. 8, the feedstock hopper 50 is disposed behind the housing 31 for the crushing mechanism and toward the rear of the compact mobile crusher 20.

Figure 6:
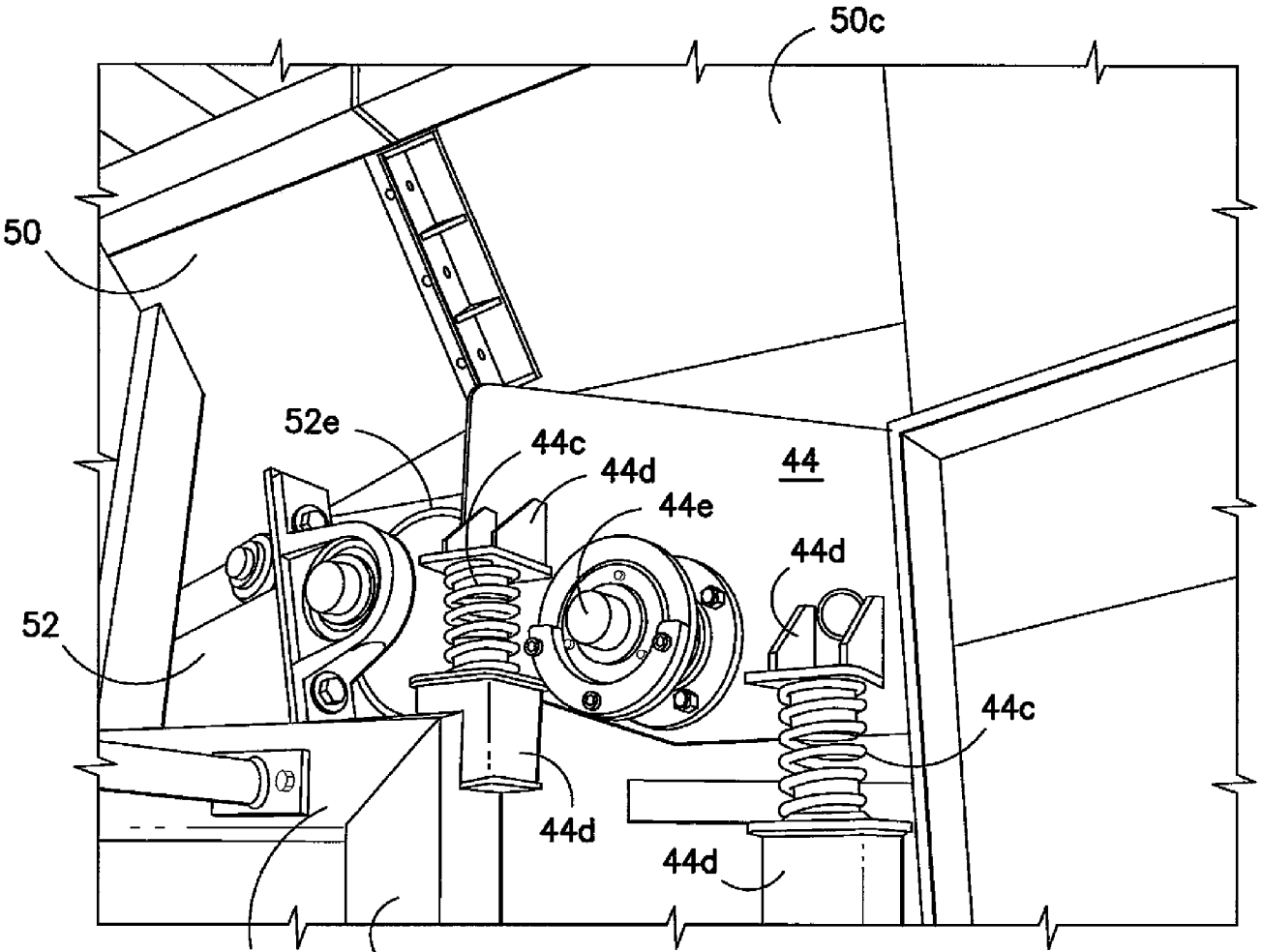
FIG. 6 is a side close-up view of components in the middle of the right side of a partially constructed prototype of an embodiment of the compact mobile crushing and screening apparatus.

As shown in FIG. 6, the feedstock hopper 50 is connected at the forward end thereof to the rear end of a feeding box 50*c* that is disposed above the scalping screen 44. As shown in FIG. 4, the forward end of the feeding box 50*c* is connected to the rear end of a rock box 50*d* that is disposed over the feed inlet opening 31*a* of the crushing mechanism. The rock box 50*d* can have a hinged cover plate that desirably is hinged at the forward end of the input opening of the rock box 50*d*.

Feedstock Feeder System

The compact mobile crushing and screening apparatus desirably can include a feedstock feeder system. As shown schematically in FIGS. 1 and 2A, one presently preferred embodiment of the feedstock feeder system includes a conveyor 52, 252 carried by the skeleton framework. However, alternative embodiments of the feedstock feeder system can include a vibrating grizzly feeder for example. As shown schematically in FIGS. 1 and 2A, the feedstock conveyor 52, 252 is disposed directly beneath the outlet of the feedstock hopper 50, 250 at the bottom of the feedstock hopper 50, 250. As shown in FIG. 3, FIG. 13, FIG. 14 and FIGS. 1 and 2A, the feedstock conveyor 52, 252 desirably includes a plurality of heavy duty rubber impact idlers 52*a*, 252*a* that are rotatably mounted beneath the bottom edge of the feedstock hopper 50, 250. These idlers 52*a*, 252*a* are special impact style idlers, which are desirable to handle the forces generated by the impact of the falling debris that will be dumped into the feedstock hopper 50, 250. Each idler 52*a*, 252*a* is formed desirably as a heavy duty black rubber disc. Alternatively, in place of a plurality of heavy duty rubber impact idlers 52*a*, 252*a*, it is desirable to employ an impact slider bed either alone or in combination with some heavy duty rubber impact idlers 52*a*, 252*a*.

Figure 13:
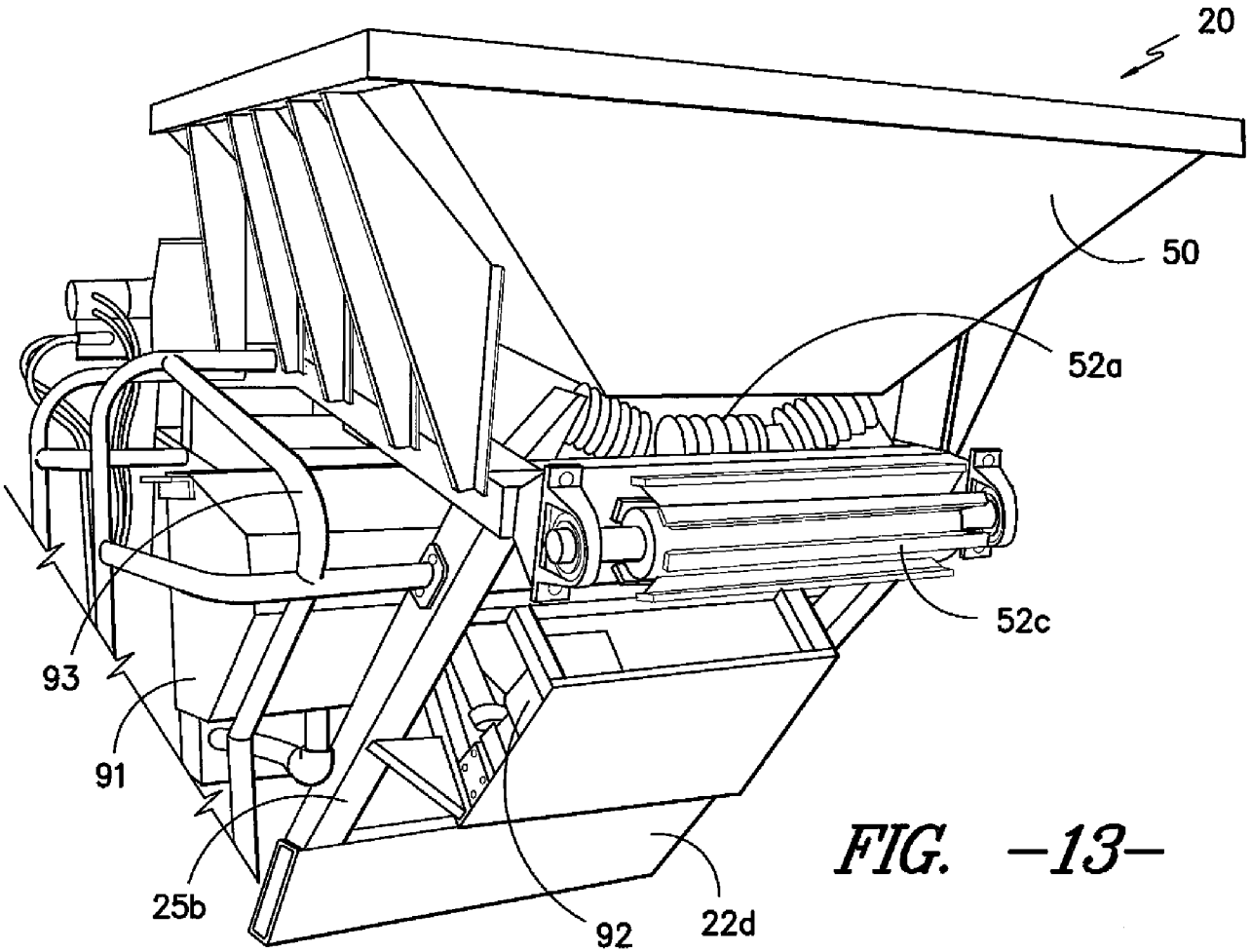
FIG. 13 is an elevated perspective view taken from the rear of the left side of a partially constructed prototype of an embodiment of the compact mobile crushing and screening apparatus.
Figure 14:
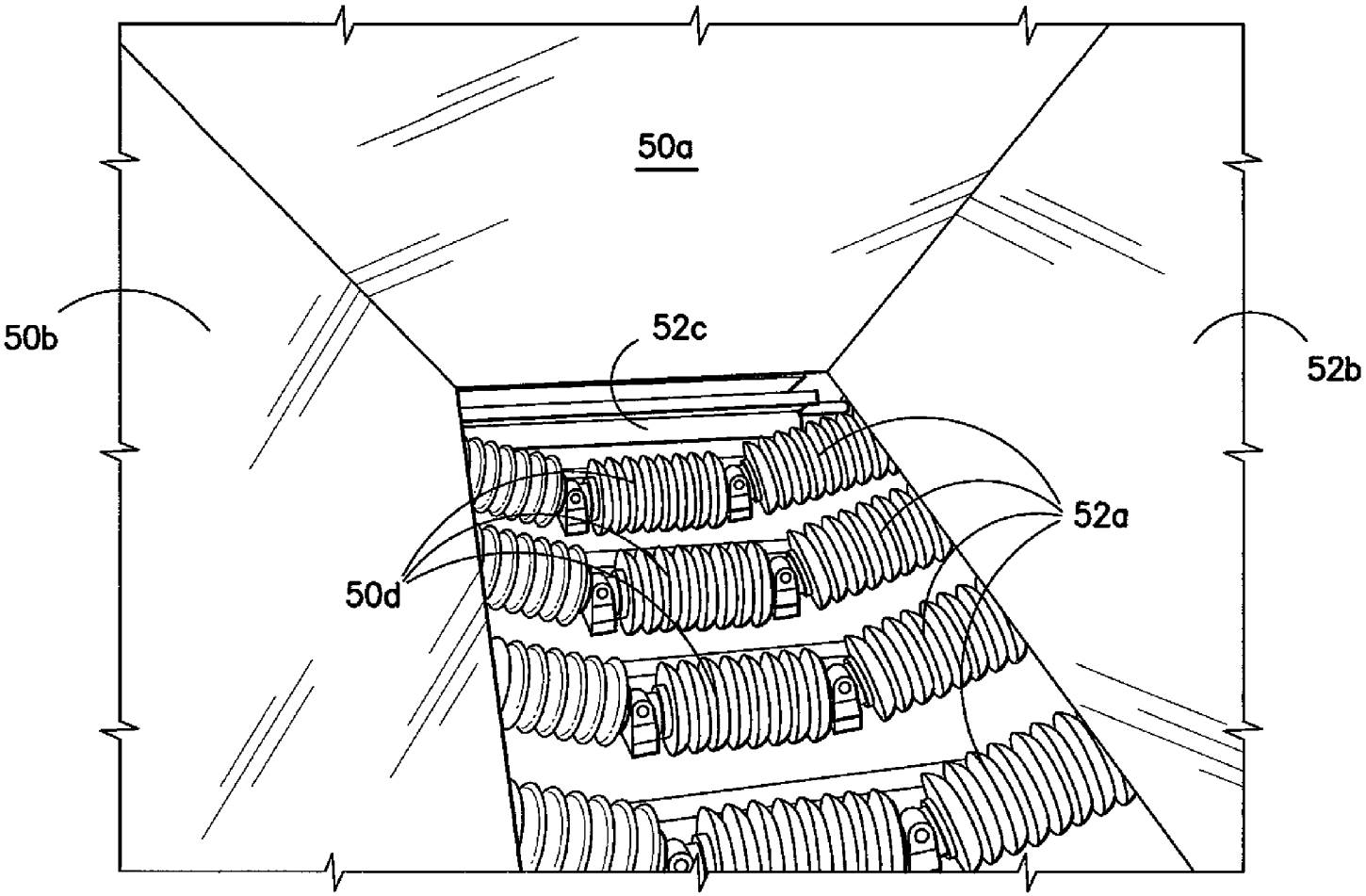
FIG. 14 is an elevated perspective view taken from the forward end of the feedstock hopper rear of the left side of a partially constructed prototype of an embodiment of the compact mobile crushing and screening apparatus.

FIG. 15 is a view taken from above the feedstock hopper 50 and looking into the feedstock hopper back toward the angled rear wall 50*a* of the feedstock hopper and showing the angled side walls 50*b* of the feedstock hopper. As shown in FIG. 15, the feedstock conveyor's tail pulley 52*c* can be seen beneath the angled rear wall 50*a* of the feedstock hopper 50. The conveyor belt has been removed in the views of FIG. 13, FIG. 14, FIG. 15 and FIGS. 1 and 2A, but would pass over and be supported by the top edges of the idlers 52*a*, 252*a*. As shown in FIG. 14 and FIG. 15, each row of aligned idlers 52*a* is configured to rotate about an upwardly angled axis at each end of a middle row 52*d* of idlers 52*a* that rotate about a horizontally disposed axis.

Figure 12:
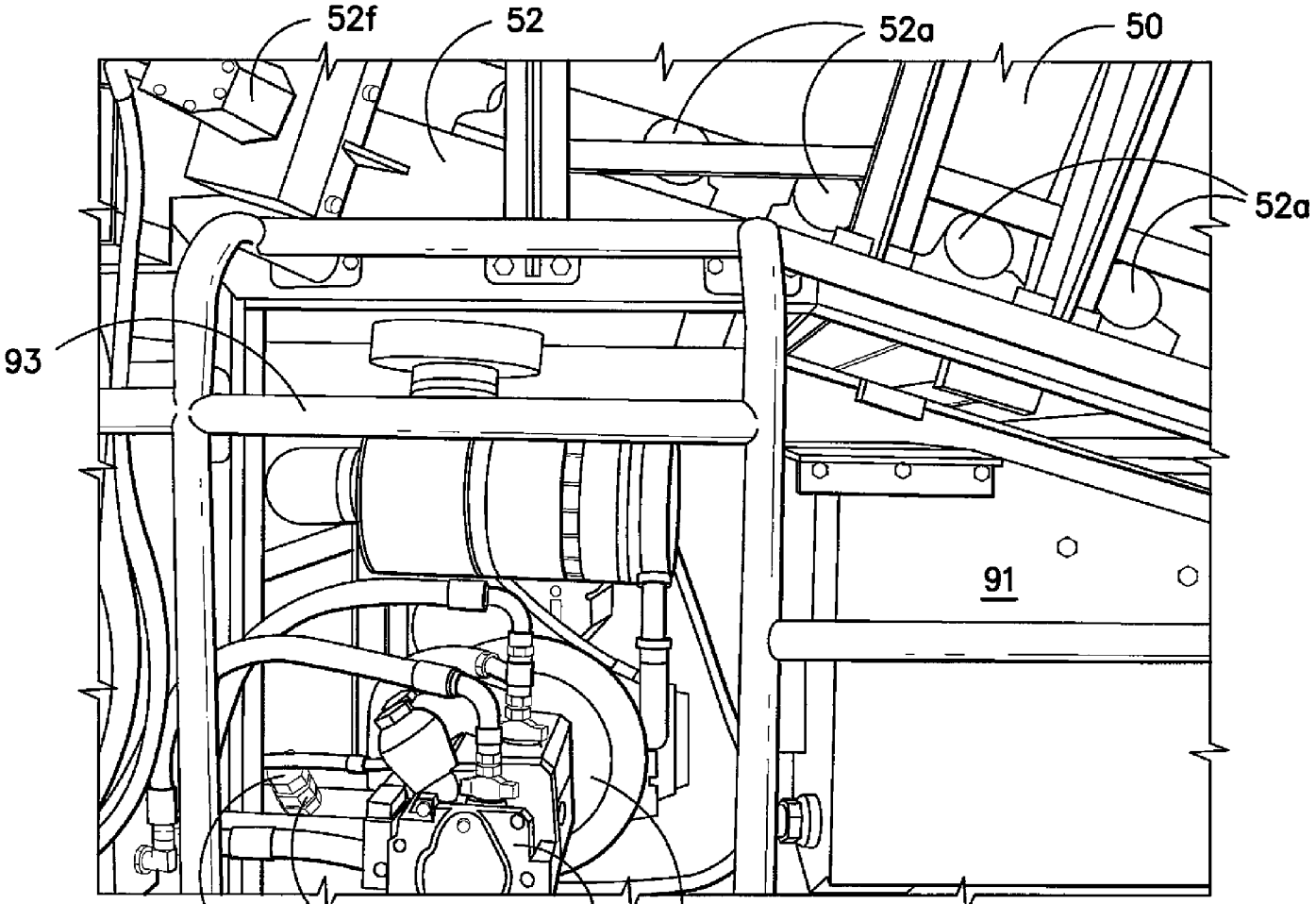
FIG. 12 is a close-up view of part of the middle of the left side of a partially constructed prototype of an embodiment of the compact mobile crushing and screening apparatus.

The debris that is to be crushed is dumped into the feedstock hopper 50 and falls on top of the feedstock conveyor 52, which is shown without the attached continuous belt in FIG. 4. The end of the forward-most roller 52*e*, which is the driven roller 52*e*, of the feedstock conveyor 52 is shown in FIG. 4. The feedstock conveyor belt 52*b* can be seen in the view shown in FIG. 16 and transports the feedstock debris initially to a pre-screen 44 such as a scalping screen. As shown in FIG. 12, a hydraulic motor and drive 52*f* powers the continuous belt (shown in FIG. 15) of the feedstock conveyor 52 that moves the debris from the feedstock hopper 50 to the scalper screen that is disposed between the feedstock hopper and the inlet of the crushing mechanism.

The feedstock conveyor 52 can be variable speed controlled, and can be operated in a forward direction or in a reverse direction to clear jams. Additionally, the control mechanism of the feedstock conveyor 52 desirably has an option for stopping or slowing the feedstock conveyor 52 automatically when the crushing chamber of the crushing mechanism becomes blocked or full. Sensors or laser style eyes desirably are configured and disposed so that they can detect such blockage and indicate such blockage to the control mechanism. Once the sensor is set off, the control mechanism would shut down or slow down the feedstock conveyor 52.

As shown in FIG. 4, the presently preferred feedstock conveyor 52 that is disposed under the feedstock hopper 50 is an inclined feeder, which inclines upwardly moving from the rear of the compact mobile crusher 20 toward the front of the crusher and to the pre-screen described below. However, in alternative embodiments of the feedstock feeder system, horizontally disposed feeders, including conveyors and vibrating grizzly screens, can be employed. As schematically shown in FIGS. 1 and 2A, the driven roller of 52*e*, 252*e* of the feedstock conveyor 52, 252 is disposed at the highest point of the feedstock conveyor 52, 252, while the tail pulley 52*c*, 252*c* of the feedstock conveyor 52, 252 is disposed at the lowest point of the feedstock conveyor 52, 252. As such, the rear end of the feedstock conveyor 52, 252 can be positioned to be as close to the ground as necessary so that a machine/loader of any height capability nonetheless can feed into the hopper 50, 250 and onto the conveyor 52, 252, the feedstock material to be processed by the compact mobile crusher 20, 200.

Pre-Screen

Sometimes there is too much dirt on a job site, and the presence of dirt in the crushing mechanism would contaminate the desired crushed product. In order to process the feedstock material, whether it be concrete or asphalt, etc., it may be necessary to remove the unwanted dirt from the feedstock material.

As shown schematically in FIGS. 1 and 2A, the compact mobile crusher 20, 200 desirably can include a pre-screen 44, 244 carried by the skeleton framework. As embodied herein, the pre-screen desirably is provided by a scalping screen 44, 244. The scalping screen 44, 244 screens out dirt from the feedstock material before the feedstock material enters the crushing mechanism 30, 230. FIG. 15 is a view taken from above the feedstock hopper 50 and looking into the feedstock hopper 50 forward toward the feed inlet opening 31*a* and the top of the discharge chute 44*a* disposed beneath scalping screen. The scalping screen 44 can have any of variously sized screen cloth/media bolted to the end rods 44*f* of the scalping screen to screen out variously sized materials and/or dirt. Thus, the variously sized screen cloth/media bolted to the end rods 44*f* of the scalping screen 44 can be changed to regulate the size of the material removed from the stream of feedstock entering the feed inlet opening 31*a*. The screen cloth that normally would be installed and held between the end rods 44*f* as part of the scalping screen has been removed in this view of FIG. 15 to permit viewing of the mechanism that otherwise would be beneath the screen and not exposed to the viewer. The pivotally driven shaft 44*e* that drives the scalping screen 44 is connected to and driven by a hydraulic motor and drive mechanism 44*b* as shown in FIG. 11.

Moreover, the scalping screen 44, 244 desirably can be driven in either the forward direction down into the feed inlet opening 31*a* or in the reverse direction down away from the feed inlet opening 31*a* and upwardly toward the feedstock conveyor 52, 252. By being driven in the reverse direction against the force of gravity, the scalping screen 44, 244 desirably is capable of maintaining the feedstock material on the scalping screen 44, 244 for a relatively longer period of time and thus providing a more thorough screening of the feedstock material.

When debris strikes the scalping screen 44, the force of the falling debris causes the rotation of the scalping screen 44 about the central shaft 44*e* as the shifting weight causes compression of the springs 44*c* mounted on the supports 44*d* at the front and rear on each side of the scalping screen 44. In this way, feedstock material that is too large to pass through the mesh of the scalping screen 44 is bounced and thrown into the feed inlet opening 31*a* of the crushing mechanism that is disposed within the crusher housing 31 therefor.

As shown in FIG. 4, a right side horizontally disposed support beam 26 of the main skeleton carries a chute 44*a* that has an outlet that feeds on top of the conveyor belt (not shown) of the side dirt conveyor 40. As shown in FIG. 11 and FIG. 6, the scalping screen 44 is carried on springs 44*c* loaded between supports 44*d* that themselves are carried on the stanchion 23 of the skeleton framework. As shown in FIG. 11, the supports 44*d* are carried on the main horizontal support beam 26 of the skeleton framework of the compact mobile crusher. The end of the driven shaft 44*e* that drives the scalping screen 44 is shown in FIG. 4 and FIG. 6.

Desirably, the scalping screen 44 is optionally removable from the processing stations for the feedstock. In order to implement such removal, the scalping screen 44 can have a solid panel (not shown) bolted above the shafts 44*e*, 44*f* and extending between the feed inlet opening 31*a* and the forward end of the feedstock conveyor 52 so as to prevent any material from passing through and being processed by the scalping screen 44.

As schematically shown in FIGS. 1, 1A and 2A, while the respective feedstock conveyor 52, 252 moves the feedstock material upwardly and so feeds upwardly to the respective driven roller 52*e*, 252*e* of the feedstock conveyor 52, 252, the respective scalping screen 44, 244 is disposed on a downward slope in the direction moving away from the driven roller 52*e*, 252*e* of the feedstock conveyor 52, 252 and toward the respective feed inlet opening 31*a*, 231*a* of the respective crusher housing 31, 231. This downward slope of the scalping screen 44 also can be seen in FIG. 4 and FIG. 6 and desirably is in a range of about 15 degrees to about 20 degrees beneath the horizontal plane.

Recycle material is mostly slabs, which tend to bridge at the feed inlet opening of the crushing mechanism when transitioning from the feed conveyor into the feed inlet opening of the crushing mechanism. The downward slope of the scalping screen 44, 244 allows relatively flat slabs of material in the feedstock material to transition better than would occur if the same slabby material were fed into the crushing mechanism from a flat or horizontal feedstock feeder system. As shown schematically in FIG. 1A, the slabs feed much better when the scalping screen 44 is sloping down into the feed opening 31*a* to the jaws 30*a*, 30*b* of the crushing mechanism because the slope of the scalping screen 44 turns the longer dimension of the flat slabs at an angle rather than entering the gap between the jaws 30*a*, 30*b* of the crusher with the longer dimension of the flat slabs disposed in a horizontal orientation. By having the scalping screen 44 sloping downwardly into the feed inlet opening 31*a*, the compact mobile crusher 20 minimizes bridging and thus ensures the best results without stoppage or bridging. Also, by having the respective scalping screen 44, 244 sloped downwards towards the respective feed inlet opening 31*a*, 231*a* the respective compact mobile crusher 20, 200 maximizes the effective height of the respective feed inlet opening 31*a*, 231*a*.

Side Conveyor for Pre-Screen

As shown schematically in FIGS. 1 and 2A, the compact mobile crusher 20, 200 includes a side conveyor 40, 240 carried by the skeleton framework. As shown in FIG. 7, the side dirt conveyor 40 extends outwardly from the right side of the main structural frame of the compact mobile crusher 20. The side conveyor 40, 240 moves the dirt that is separated from the feedstock material that is fed into the large feedstock hopper 50, 250 that is disposed rearwardly of the crusher housing 31, 231 and toward the rear of the compact mobile crusher 20, 200.

As shown in FIG. 4, the side conveyor 40 has a driven roller 40*a* at the free end of the side conveyor 40. A drive motor 40*b*, which in the disclosed embodiment is a hydraulic motor but can be a motor powered by alternative means such as electricity for example, is connected in a manner so as to power the rotation of the driven roller 40*a* of the side conveyor 40. The drive motor 40*b* can move the side conveyor 40 in either the forward or reverse direction. As shown in FIG. 5, the side conveyor 40 includes an idler roller 40*c*.

The tail pulley 40*d* for the side conveyor 40 is shown in the lower foreground of FIG. 10. As shown in FIG. 10, the tail pulley 40*d* for the side conveyor 40 desirably is rotatably disposed within a cage having spaced apart scraper bars 40*e* that remove any debris that might become stuck to the conveyor belt, which is not shown in this view in order to expose the underlying series of spaced apart, rotatable idler rollers 40*c* that lie beneath the continuous belt that otherwise form part of the side conveyor 40. The cross-section of the chute 44*a* that is disposed beneath the scalper screen has a trapezoidal shaped with the shorter base nearer to the underlying idler rollers 40*c* of the side conveyor 40. The discharge chute 44*a* for the scalper screen is connected to the horizontal brace 26 that spans between the main vertical stanchion 23 of the skeleton of the compact mobile crusher and the rearward angled bulkhead 27 of the skeleton frame to which the housing 31 for the crushing mechanism is bolted.

When deployed in its operating condition, the side conveyor 40, 240 is configured so that it folds up and extends out over and across the track 21, 210. When not deployed in its operating condition, the side conveyor 40, 240 folds up to reduce the footprint of the compact mobile crusher 20, 200 for transport. Moreover, the weight of the side conveyor 40, 240 is desirably built light enough to be folded up by hand. This is a unique aspect of the side conveyor 40, 240, as conventional side conveyors require hydraulic cylinders to be raised and lowered or a crane and cables. Though the side conveyor 40 shown in FIG. 4 extends in a direction that is normal to the side of the crusher 20, the side conveyor 40, 240 can extend at an angle, either forwardly or rearwardly, with respect to the respective side of the crusher 20, 200.

Discharge Conveyor

Figure 22:
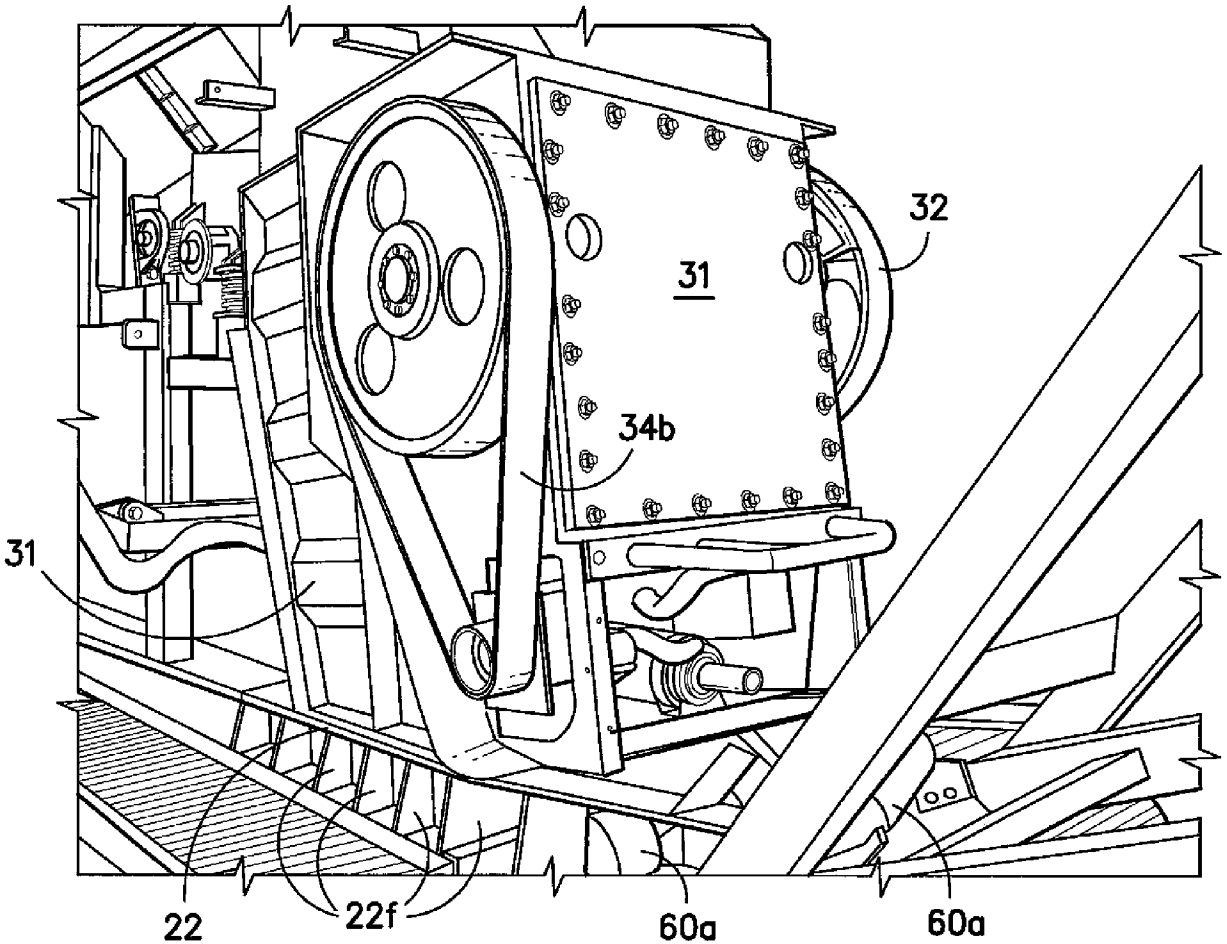
FIG. 22 is an elevated perspective view taken from the right side of certain components of a prototype of an embodiment of the compact mobile crushing and screening apparatus.

The outlet of the housing 31 for the crushing mechanism empties onto a discharge conveyor that has at least two sections or runs, which desirably are aligned with one another. There is the under crusher section 60 that is disposed underneath the crushing mechanism 30, and there is the front section 70 that is disposed in front of the compact mobile crusher 20 and desirably elevates from the level of the under crusher section 60. The under crusher section 60 of the discharge conveyor disposed beneath the discharge opening beneath the housing 31 for the crushing mechanism 30 is carried by the skeleton framework. As shown in FIG. 22 for example, the transverse axles supporting the idler rollers 60*a* of the under crusher section 60 of the discharge conveyor are integrated into the parallel opposed base beams 22 of the skeleton frame. Each of the base beams 22 is provided with holes 22*f* that reduce its weight and provide service access to the under crusher section 60 of the discharge conveyor. As shown in FIG. 4, access holes 22*f* are provided so that the idler rollers 60*a* for the under crusher section 60 of the discharge conveyor can be serviced. The front end of the under crusher section 60 of the discharge conveyor extends to the rear end of an elevating front section 70 of the discharge conveyor that is shown in FIG. 1 without the continuous conveyor belt in order to reveal the idler rollers 41.

As shown schematically in FIGS. 1 and 2A, the discharge conveyor of the compact mobile crushing and screening apparatus desirably includes an elevating front section 70, 270 that is carried by the skeleton framework. The front section 70, 270 of the discharge conveyor desirably is configured and disposed to carry away from the under crusher section 60 of the discharge conveyor, the matter that is processed through the crushing mechanism and discharged from the outlet of the crusher housing 31 for the crushing mechanism. As shown in FIG. 7, the main structural frame of the compact mobile crusher 20 includes a forwardly projecting structure 29 that is configured to support the elevating front section 70 of the discharge conveyor. As shown in FIG. 7 and schematically shown in FIGS. 1 and 2A, the forwardly projecting structure 29, 229 supports the shafts on which are rotatably mounted the idler rollers 41, 241 of the front section 70, 270 of the discharge conveyor. The forward structural frame 29, 229 is disposed desirably at an acute angle above the horizontal plane in which the axles 21*a* for the continuous track drive mechanism of the compact mobile crusher 20 are disposed.

Figure 19:
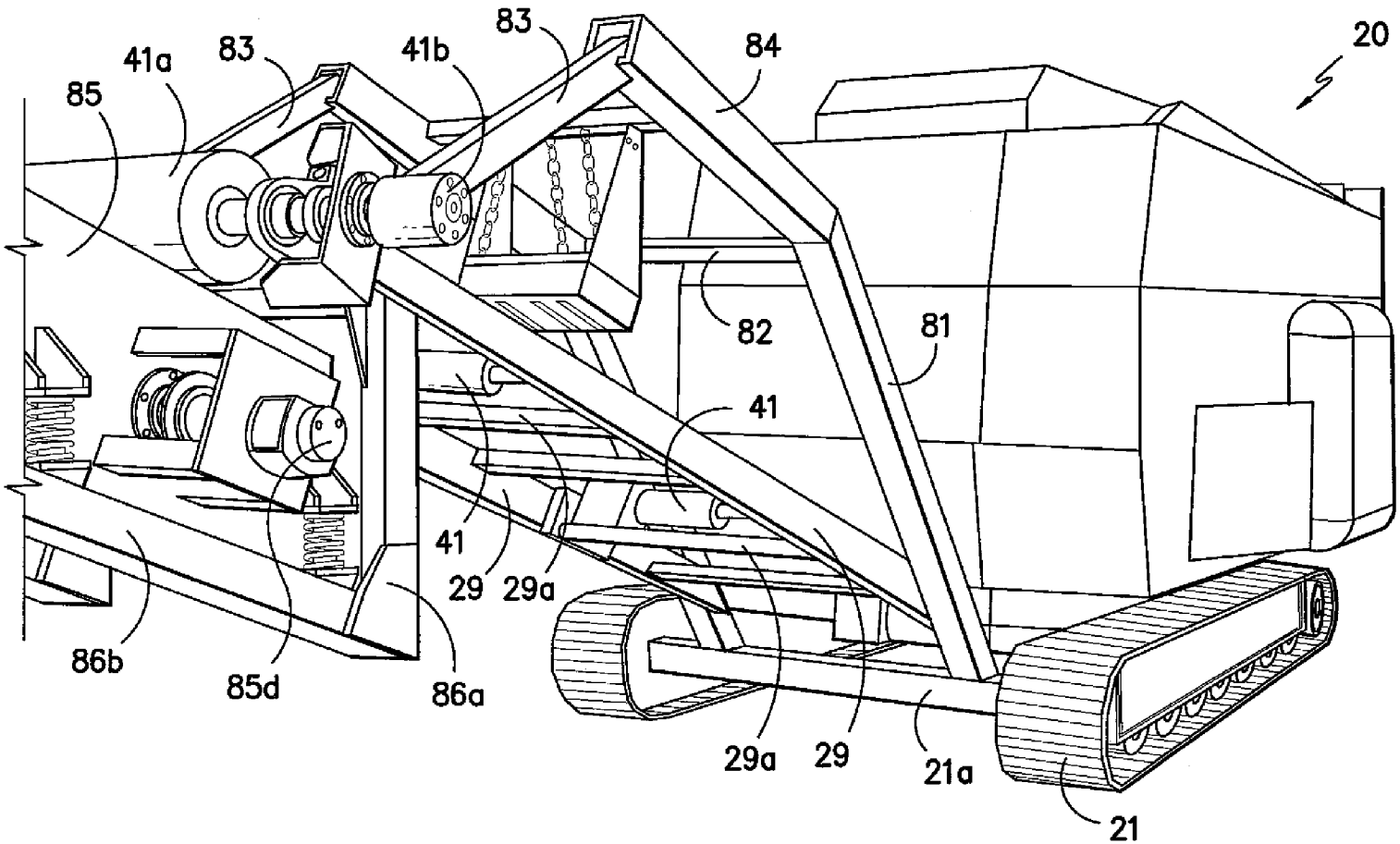
FIG. 19 is an elevated perspective view taken from the left side of components in the front of an embodiment of the compact mobile crushing and screening apparatus.

Though the belt is omitted from the view of the discharge conveyor shown in FIG. 7, the discharge conveyor desirably is configured as a continuous belt conveyor that runs from the rear end of the under crusher section 60 to the elevated end of the front section 70 of the discharge conveyor. As shown in FIG. 8, FIG. 18 and FIG. 19, the driven roller 41*a* that rotates beneath and moves the continuous belt (not shown) of the discharge conveyor is desirably powered by a hydraulic motor and drive 41*b*.

FIG. 8 is a perspective view taken from the front left side of the compact mobile crushing and screening apparatus. As shown in FIG. 8, the discharge conveyor belt mechanism includes a front end drive roller 41*a* that is powered by a hydraulic motor 41*b*. The front section 70 of the discharge conveyor includes a left side forwardly projecting structure 29 that carries and supports the intermediate idler rollers 41 on which the continuous belt (not shown) of the front section 70 of the discharge conveyor are carried and supported. By driving the front end drive roller 41*a*, the hydraulic motor 41*b* drives the continuous belt (not shown) of the discharge conveyor.

Figure 20:
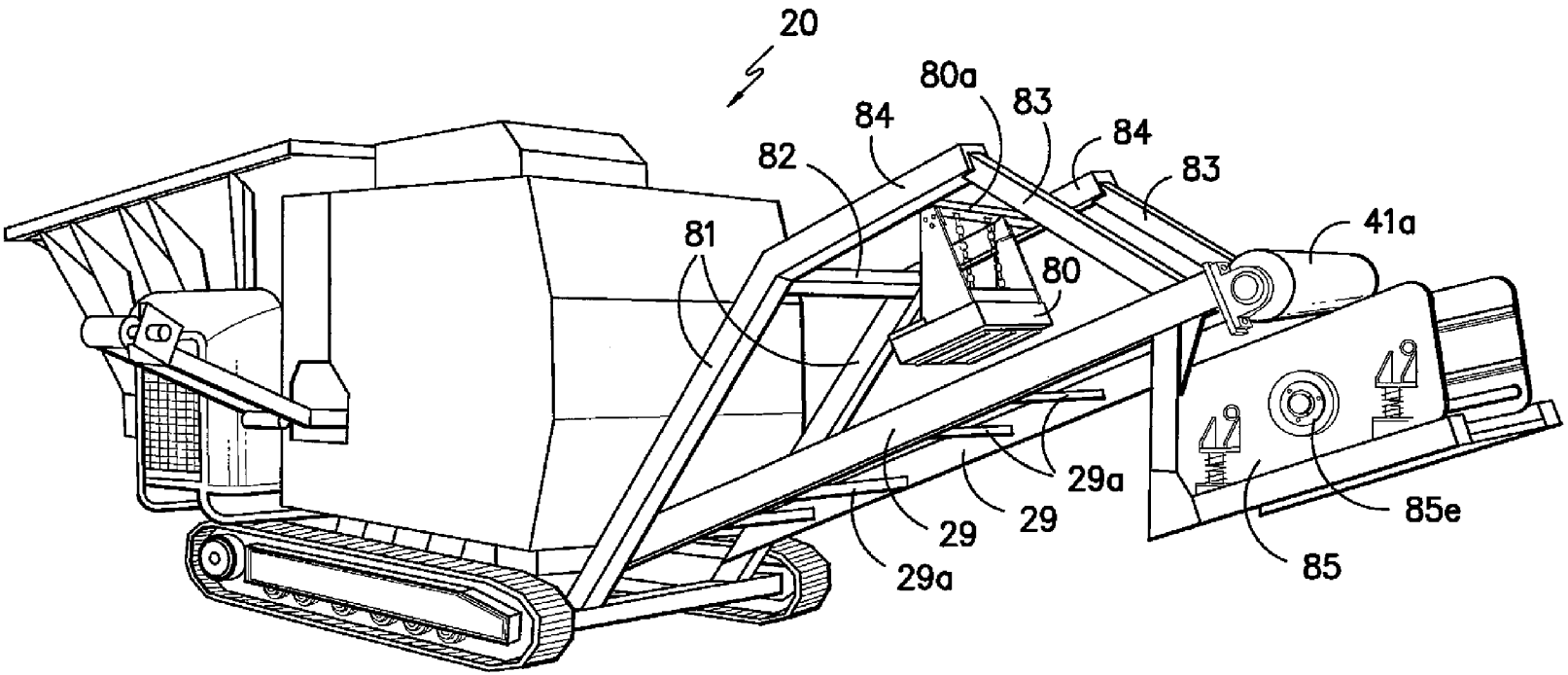
FIG. 20 is an elevated perspective view taken from the right side of components in the front of an embodiment of the compact mobile crushing and screening apparatus.

As shown in FIG. 19 and FIG. 20, the forwardly projecting structures 29 are angled upwardly at an acute angle above the horizontal plane that would be formed by the level ground on which the compact mobile crusher 20 would stand. As shown in FIG. 19 and FIG. 20 for example, the pair of parallel forwardly projecting structures 29 are joined together by a plurality of transversely extending support bars 29*a* that form the discharge conveyor's elevating front section that is generally designated by the numeral 70, 270 in FIGS. 1 and 2A. As shown in FIG. 19, the support bars 29*a* are disposed beneath a plurality of idler rollers 41 that underlie and support the continuous belt (not shown in FIG. 19) of the front section 70 of the discharge conveyor. However, the forwardly projecting structures 29 do not require separate supporting legs that deploy to the ground for supporting the weight of the forwardly projecting structures 29 and the other components carried by the forwardly projecting structures 29.

Magnet

As shown schematically in FIGS. 1 and 2A, the compact mobile crushing and screening apparatus includes a magnet 80, 280 carried by the forward structural frame 29, 229. Desirably, the magnet 80, 280 is of the self-cleaning kind.

As shown in FIG. 20, a superstructure frame is mounted above the forwardly projecting structures 29 and carries the magnet 80. As shown in FIG. 20, this superstructure includes a pair of rear forwardly angled beams 81 that are disposed parallel to each other and connected by a cross brace 82. As shown schematically in FIGS. 1 and 2A, the lower end of each rear forwardly angled beam 81, 281 is connected to the rear end of a respective forwardly projecting structure 29, 229. The superstructure further includes a pair of front rearwardly angled beams 83, 283 having a front end connected to the front end of each respective forwardly projecting structure 29, 229. The front rearwardly angled beams 83, 283 are disposed parallel to each other. As shown schematically in FIGS. 1 and 2A, each of a pair of parallel bridge beams 84, 284 has a rear end connected to the front end of a respective one of the rear forwardly angled beams 81, 281 and a front end connected respectively to a rear end of each of the front rearwardly angled beams 83, 283.

Figure 17:
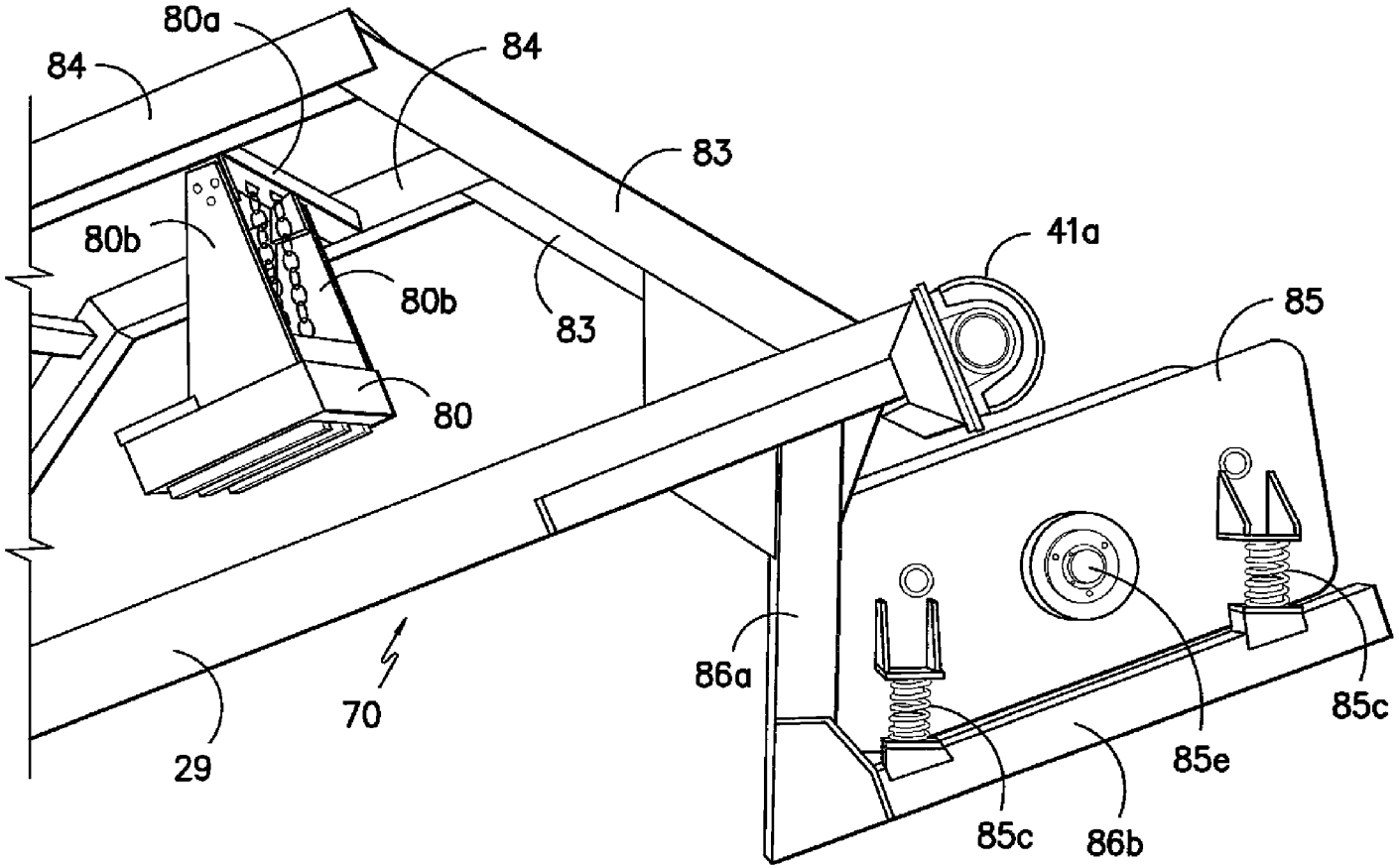
FIG. 17 is an elevated perspective view taken from the right side of components in the front of an embodiment of the compact mobile crushing and screening apparatus.

As shown in FIG. 20 and schematically in FIG. 2A for example, a magnet support beam 80*a* is disposed and connected on each opposite end to one of the bridge beams 84 and supports the weight of the magnet 80 suspended beneath the magnet support beam 80*a*. As shown in FIG. 17 for example, the magnet 80 is supported beneath the magnet support beam 80*a* by a pair of depending magnet support brackets 80*b*, which are pivotally connected to the magnet support beam 80*a*. The magnet 80 is provided with a height adjustment mechanism so that the magnet can be raised and lowered for disposition at different heights above the front section 70 of the discharge conveyor.

Screening/Separator

As shown schematically in FIGS. 1 and 2A, the compact mobile crushing and screening apparatus includes a screening/separator 85, 285 carried by the forward structural frame 29, 229. Moreover, the screening/separator 85, 285 desirably does not require separate supporting legs that deploy to the ground for supporting the weight of the forward structural frame 29, 229 and the screening/separator 85, 285. FIG. 18 is an elevated perspective view taken from directly in front of the end of the screening/separator 85 carried by the forward structural frame of an embodiment of the compact mobile crusher 20. As shown schematically in FIGS. 1 and 2A, the screening/separator 85, 285 is detachably attached to the front section 70, 270 of the discharge conveyor just forward and beneath the front end drive roller 41*a*, 241*a* of the front section 70, 270 of the discharge conveyor. The screening/separator 85, 285 is configured so that it can be folded down for transport.

The purpose of this screening/separator 85, 285 is to size/separate the crushed material into different sizes. The screening/separator 85, 285 can have multiple decks, each with a differently sized screening plate. The screening/separator 85, 285 respectively shown in FIG. 18 and schematically in FIG. 2A has two decks, and a different screening plate 85*a*, 85*b*, 285*a*, 285*b* is mounted respectively on the top deck and bottom deck of this screening/separator 85, 285 to sort differently sized particulates out of the material discharged off of the front end drive roller 41*a*, 241*a* of the front section 70, 270 of the discharge conveyor and entering the top of the screening/separator 85, 285. In the embodiment shown in FIG. 18, notice that the openings through the screening plate 85*a* of the top deck are larger than the openings through the screening plate 85*b* of the bottom deck.

As shown in FIG. 18, the lower section of the screening/separator 85 is mounted on springs 85*c* that rest on a frame assembly 86*a*, 86*b* that is attached to the free end of the front section 70 of the discharge conveyor. The screening/separator 85 can be removed from the frame assembly by simply lifting it off the springs 85*c* or removing the entire frame assembly and screening/separator 85 from the end of the front section 70 of the discharge conveyor. Desirably, the screening/separator 85 can be hydraulically driven in a pivoting or rocking motion by an hydraulic motor and drive 85*d*, which can be connected to a drive shaft 85*e* (see FIG. 17) so that the screening/separator 85 shakes similarly to the operation of the scalping screen 44. Moreover, the screening/separator 85, 285 desirably can be driven in either the forward direction away from the crushing mechanism 30, 230 or in the reverse direction toward the crushing mechanism 30, 230.

Because the screening/separator 85, 285 shown in FIG. 18 and schematically in FIG. 2A has two decks, it will produce three differently sized products. In a screening/separator 85, 285 having two decks, one above the other, the material may pass through the screening plate 85*a*, 285*a* of the top deck but not pass through the screening plate 85*b*, 285*b* of the bottom deck.

Figure 2B:
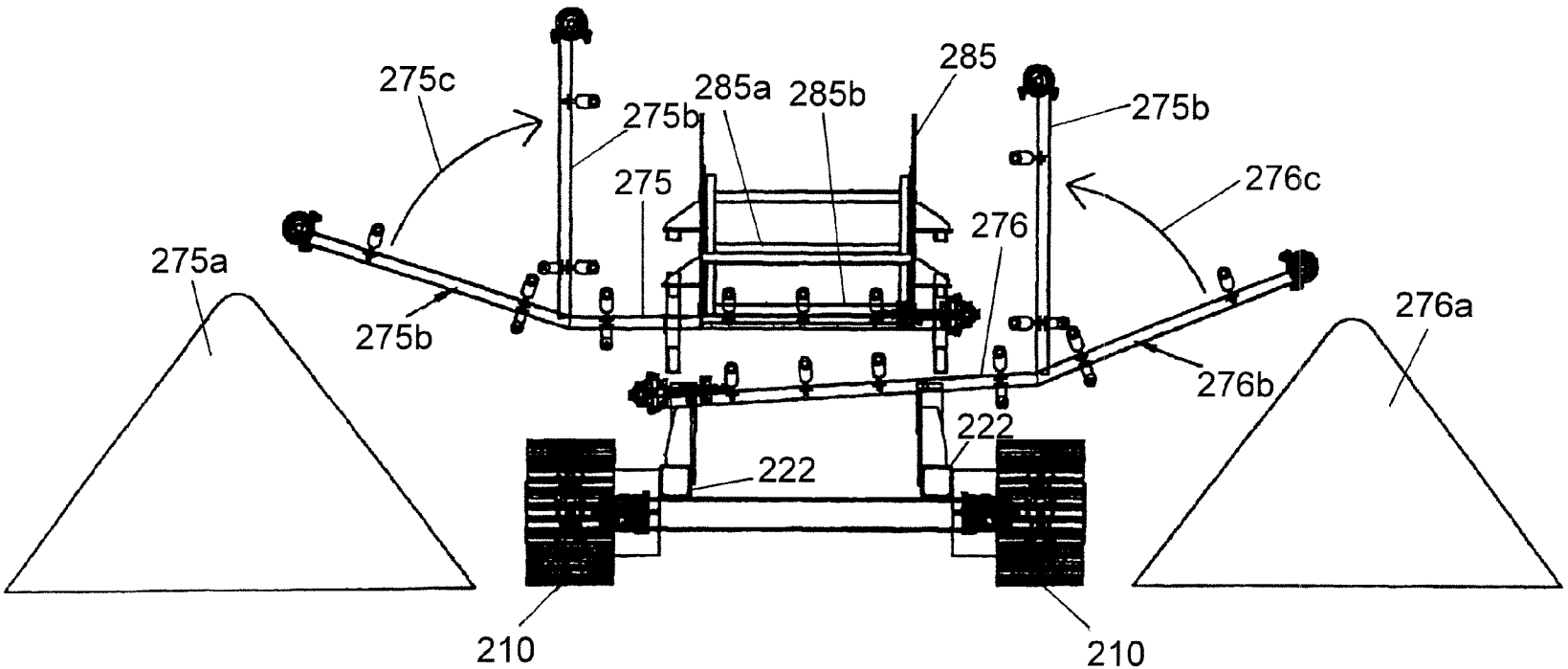
FIG. 2B is a schematic representation of an alternative embodiment of the compact mobile crushing and screening apparatus of the present invention viewed from the front head on with certain structures omitted in order to explain the relationships between other structures.
Figure 3:
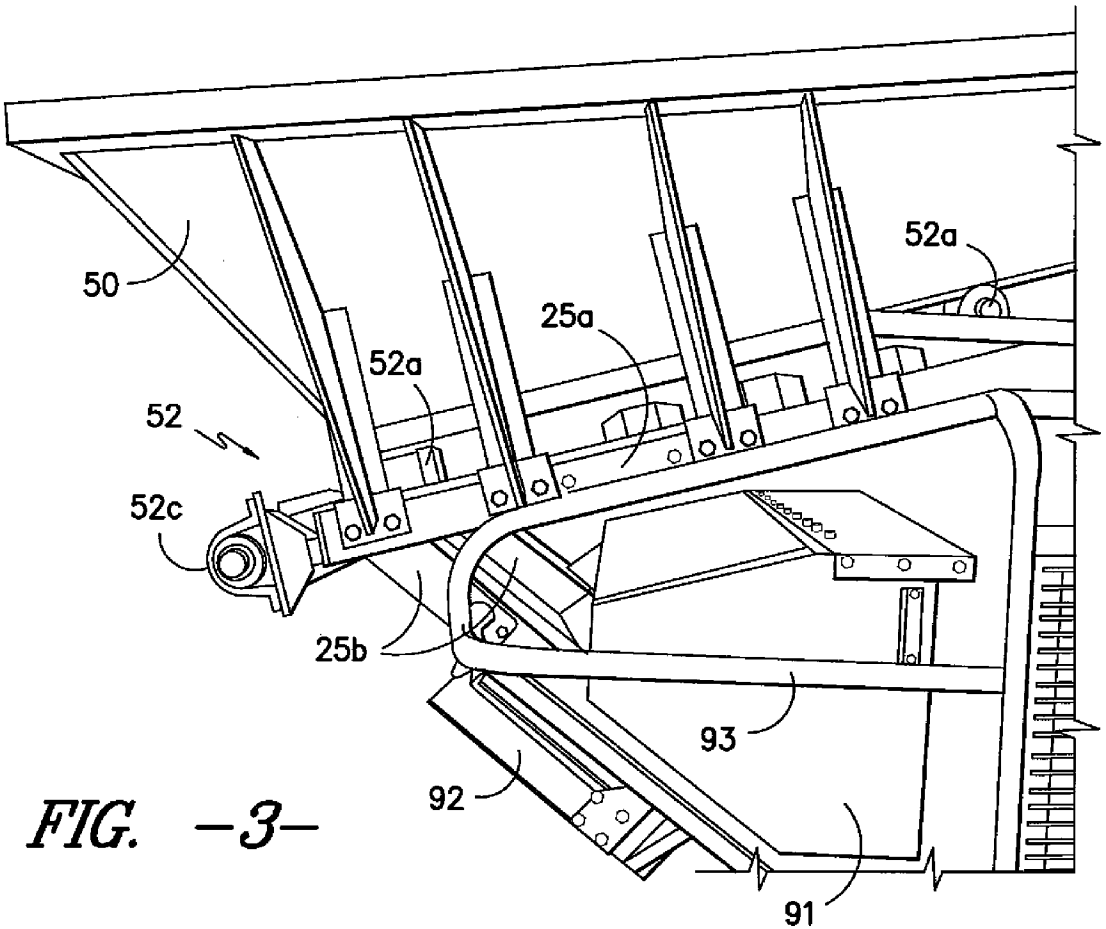
FIG. 3 shows a close-up view of part of the right rear side of a prototype of an embodiment of the compact mobile crushing and screening apparatus.

As shown schematically in FIGS. 2A and 2B, additional side conveyors or chutes 275, 276 can be positioned so as to receive material processed by the screening/separator 285 to direct each differently sized stream of particulate material into any one of various stock piles 275*a*, 276*a* or to further conveyors. As shown schematically in FIG. 2A, each of the two decks of the screening/separator 85, 285 is angled downwardly and rearwardly toward the crushing mechanism 230 and toward the side conveyors or chutes 275, 276. A first side conveyor 275 can be disposed beneath the discharge end of the top deck so as to receive material that was too large to pass through the screening plate 285*a* of the top deck and thus falls under the influence of gravity into the first side conveyor 275. Similarly, a second side conveyor 276 can be disposed beneath the discharge end of the bottom deck so as to receive material that was too large to pass through the screening plate 285*b* of the bottom deck and thus fails under the influence of gravity into the second side conveyor 276. Though each of the side conveyors 275, 276 shown in FIGS. 2A and 2B projects outwardly in a direction that is normal to the forwardly projecting structure 229, the side conveyor 275, 276 can extend at an angle, either forwardly or rearwardly, with respect to the direction in which the forwardly projecting structure 229 extends.

The additional conveyors 275, 276 can be powered by the compact mobile crusher 200. The additional conveyors 275, 276 can be configured to further discharge material away from the compact mobile crusher 200 or can be configured to allow for recirculation of oversize particulates back to the crushing mechanism 230 of the compact mobile crusher 200 to be re-crushed so as to obtain smaller particulates.

As shown schematically in FIG. 2B, each of the additional conveyors 275, 276 desirably can include an outlying segment 275*b*, 276*b*, that articulates and folds upwardly in the respective direction indicated by the arrows 275*c*, 276*c* to reduce the lateral footprint of the mobile crusher 200 to facilitate storage and transport of same. As shown schematically in FIG. 2A for example, in some embodiments, a forward-most conveyor 278 desirably can be carried under the screening/separator 285. This forward-most conveyor 278 desirably is an under screen fines conveyor that is configured and disposed to direct to a separate pile of fines or to additional conveyors, the finest sized stream of particulate material passing through both screening plates 285*a*, 285*b* of the screening/separator 285. This pile of fines is capable of a reduction of the disintegrated feedstock down to one one-hundredth of the size of the input feedstock.

Assuming that the scalping screen 44, 244 removes dirt from the feedstock provided to the crushing mechanism 30, 230, by appropriate setting of the shims on the crushing mechanism 30, 230, the crushing mechanism 30, 230 would produce for example 1-4" minus. The screening/separator 85, 285 would then allow the crushed particulate material to pass the through the holes in the screening plates 85*a*, 85*b*, 285*a*, 285*b* and thereby separate the crushed particulate material into two separate streams of stone particulates, each stream characterized by more uniformly sized particulates. The fines pass completely through the screening plates 85*a*, 85*b*, 285*a*, 285*b* in both decks, thus providing a capability of sorting two streams of clean stone with no fines.

Power Plant

As schematically shown in FIGS. 1 and 2A and FIG. 4, a diesel engine 90, 290 desirably is carried by the skeleton framework. As shown in FIG. 4 the diesel engine 90 desirably has a muffler 90*a*. The fuel tank for the diesel engine 90 desirably is flat and thin and positioned partially under the diesel engine 90 and under the side conveyor 40 near the skeleton frame. As schematically shown in FIGS. 1 and 2A and FIG. 4, the reservoir tank 91, 291 for the hydraulic fluid is carried by the lower leg 25*b*, 225*b* of the acutely angled pair of beams. A cooling fan 92, 292 for the hydraulic system is mounted under the hydraulic reservoir tank 91, 291 and attached to the lower leg 25*b*, 225*b* of the acutely angled pair of beams. As shown in FIG. 13, the hydraulic cooler 92 is disposed beneath the tail pulley 52*c* of the feed conveyor of the compact mobile crusher 20.

As shown in FIG. 4, the main diesel engine 90 is desirably supported by a cross brace of the skeleton framework of the compact mobile crusher and is disposed rearwardly of the crushing mechanism and the side dirt conveyor. As shown in FIG. 4, the muffler 90*a* for the diesel engine desirably can be disposed between the diesel engine 90 and the side dirt conveyor 40. The fuel filler neck 90*b* is shown in FIG. 5 connected to the diesel fuel tank 90*d*. As shown in FIG. 5 and FIG. 12, the diesel fuel filler neck 90*b* that leads to the diesel fuel tank 90*d* can be seen in FIG. 12 together with the sealing cap 90*c* on the end of the fuel filler neck 90*b*. The diesel fuel tank 90*d* desirably is disposed forwardly of the diesel engine 90 and beneath the side conveyor 40.

Figure 9:
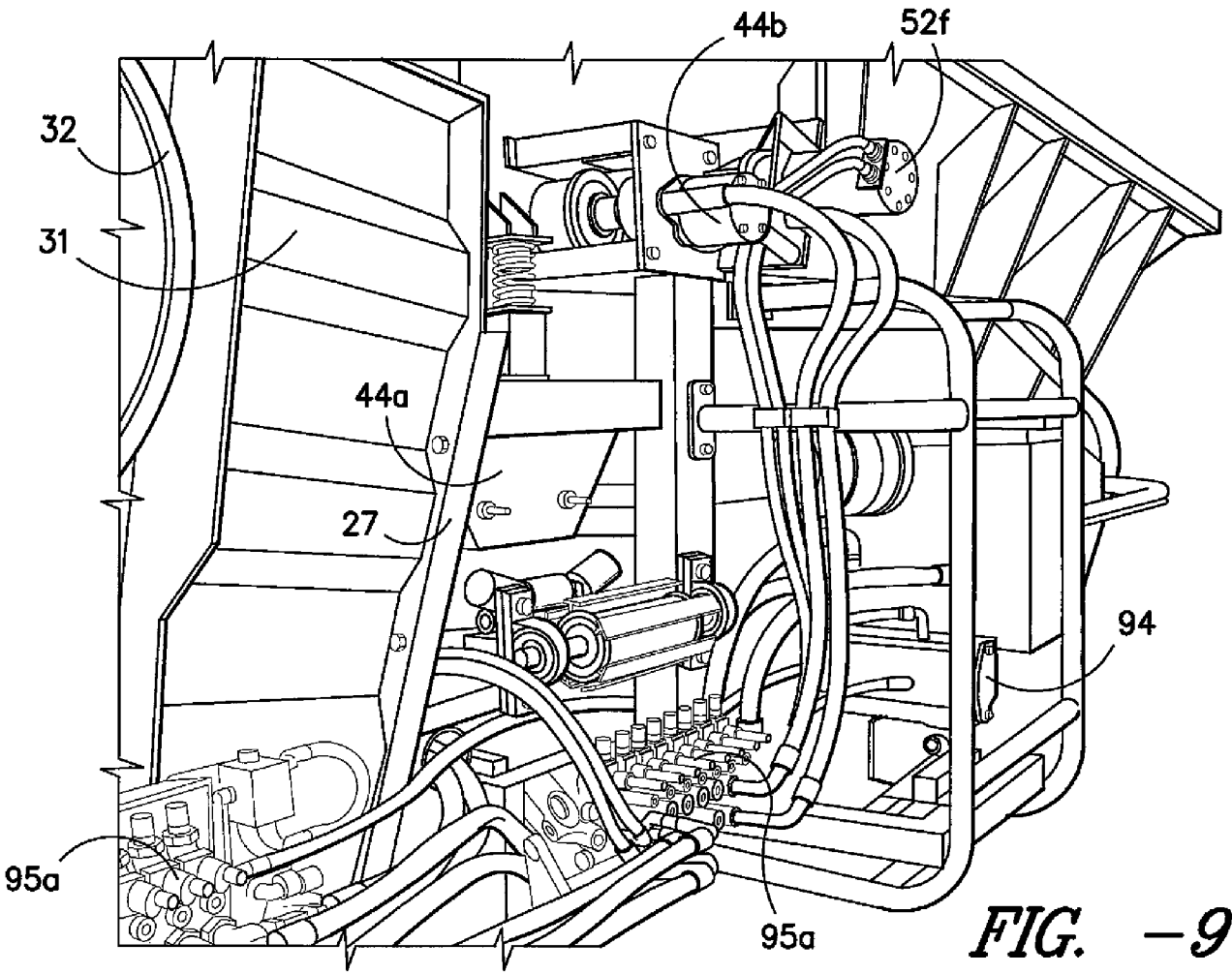
FIG. 9 is taken from the left side of a partially constructed prototype of an embodiment of the compact mobile crushing and screening apparatus looking toward the rear of the prototype.

FIG. 12 is a close-up view taken looking at the left side of the compact mobile crusher. Framed within the left side roll cage 93 can be seen the back end of the diesel engine 90, which is connected to power the main hydraulic pump 94. As shown in FIG. 9 for example, the main hydraulic pump 94 is connected to the main hydraulic fluid manifold 95. In FIG. 5, one can observe the hydraulic manifold 95 and the tops of some of the hydraulic valves 95*a* connected to the hydraulic manifold 95. As shown in FIG. 9 for example, hydraulic hoses 95*b* are routed through a rigid hose conduit 95*c* to supply hydraulic fluid to apparatus on the right side of the compact mobile crusher. The hydraulic valves 95*a* can be remotely controlled to regulate the flow of hydraulic fluid through the hydraulic lines to the hydraulic motors and drives for the feedstock conveyor 52, the scalping screen 44, the crushing mechanism 30, the magnet 80, the side conveyor 40, the front section 70 of the discharge conveyor and the tracks 21. Desirably, as shown in FIG. 4 and schematically in FIGS. 1 and 2A, the hydraulic reservoir tank 91, 291 desirably is carried rearwardly of the diesel engine 90, 290 and is supported by the left rear angular support beam 25*b*, 225*b*.

While more than one presently preferred embodiment of the invention has been described using specific terms, each such description is for illustrative purposes only, and it is to be understood that changes and variations may be made without departing from the spirit or scope of the following claims.

What is claimed is:

1. A compact mobile crushing and screening apparatus for disintegrating solid feedstock and further processing the disintegrated feedstock comprises:

a skeleton framework;

a jaw crushing mechanism carried by said skeleton framework and having a feed inlet opening of at least about 3.5 square feet and a discharge outlet;

a screening/separator carried by said skeleton framework;

a discharge conveyor carried by said skeleton framework and configured and disposed to move to said screening/separator for processing by said screening/separator disintegrated feedstock material dispensed from said discharge outlet of said jaw crushing mechanism; and wherein the weight of the overall apparatus is no more than about twenty tons (40,000 pounds) and the ratio of the area of the feed inlet opening in square feet to the weight of the overall apparatus in tons is at least about 0.25.

2. A compact mobile crushing and screening apparatus as in claim 1, further comprising a mobile track system, wherein the skeleton framework is carried by said mobile track system.

3. A compact mobile crushing and screening apparatus as in claim 1, further comprising a feedstock system that is configured to move feedstock material to the feed inlet opening of the crushing mechanism.

4. A compact mobile crushing and screening apparatus as in claim 3, wherein said feedstock system includes a pre-screen disposed next to the feed inlet opening of the crushing mechanism.

5. A compact mobile crushing and screening apparatus as in claim 4, wherein said pre-screen is disposed tilting downwardly toward the feed inlet opening of the crushing mechanism.

6. A compact mobile crushing and screening apparatus as in claim 4, wherein the feedstock system includes a moveable continuous belt feeder.

7. A compact mobile crushing and screening apparatus as in claim 4, further comprising:

a side conveyor carried by the skeleton framework and having one end disposed beneath the pre-screen.

8. A compact mobile crushing and screening apparatus as in claim 4, wherein said feedstock system includes an inclined feedstock conveyor that is configured and disposed to move feedstock material from a relatively low level above ground to a relatively higher level where the feedstock material can be provided to the pre-screen of the feedstock system.

9. A compact mobile crushing and screening apparatus as in claim 8, wherein the feedstock conveyor can be extended indefinitely until it reaches the lowest possible point.

10. A compact mobile crushing and screening apparatus as in claim 8, further comprising:

a feedstock hopper carried above the feedstock conveyor and configured to receive the feedstock material to be processed before the feedstock material is moved by the inclined feedstock conveyor.

11. A compact mobile crushing and screening apparatus as in claim 1, wherein:

the discharge conveyor having an under crusher section and a front section, the under crusher section having one end connected to the skeleton framework and the front section aligned to receive processed material from the under crusher section of the discharge conveyor.

12. A compact mobile crushing and screening apparatus as in claim 11, wherein:

the front section of the discharge conveyor is elevated above the under crusher section of the discharge conveyor connected to the skeleton framework.

13. A compact mobile crushing and screening apparatus as in claim 11, wherein:

the screening/separator has at least two separate decks, a top deck and a bottom deck disposed beneath the top deck, and wherein the bottom deck is configured to remove smaller particulate matter than can be removed by the top deck.

14. A compact mobile crushing and screening apparatus as in claim 13, further comprising:

a first side conveyor carried by the front section of the discharge conveyor and having one end disposed beneath the top deck of the screening/separator; and a second side conveyor carried by the front section of the discharge conveyor and having one end disposed beneath the bottom deck of the screening/separator.

15. A compact mobile crushing and screening apparatus as in claim 14, further comprising:

a mobile track system, wherein the skeleton framework is carried by said mobile track system;

a feedstock feeder system that is carried by the skeleton framework and configured and disposed to move feedstock material toward the feed inlet opening of the jaw crushing mechanism;

a magnet disposed over the discharge conveyor and carried by the skeleton framework; and a system for radio remote controlling operation of each of the mobile track system, the feedstock feeder system, the jaw crushing mechanism, the first side conveyor, the second side conveyor, the discharge conveyor, the magnet, and the screening/separator.

16. A compact mobile crushing and screening apparatus as in claim 11, further comprising:

a side conveyor carried by the front section of the discharge conveyor and having one end disposed to receive material processed by the screening/separator.

17. A compact mobile crushing and screening apparatus as in claim 16, wherein the screening/separator is disposed to tilt downwardly and rearwardly toward said side conveyor.

18. A compact mobile crushing and screening apparatus as in claim 11, further comprising:

a magnet disposed over the discharge conveyor and carried by the skeleton framework.

19. A compact mobile crushing and screening apparatus as in claim 18, further comprising a system for radio remote controlling operation of each of the jaw crushing mechanism, the discharge conveyor, the magnet, and the screening/separator.

20. A compact mobile crushing and screening apparatus as in claim 1, wherein the skeleton framework includes at east one substantially horizontally extending beam disposed so as to counteract the substantially horizontally directed components of the forces generated by operation of the jaw crushing mechanism.

21. A compact mobile crushing and screening apparatus for disintegrating solid feedstock and further processing the disintegrated feedstock comprises:

a mobile track system;

a skeleton framework carried by said track system;

a crusher frame integrated into the skeleton framework, which is configured and disposed to support and strengthen the crusher frame and thus reduces the mass and overall weight of the crusher frame;

a crushing mechanism having a feed inlet opening and an outlet opening, the crushing mechanism being carried by the crusher frame, wherein the feed inlet opening is large enough to accept most rock and demolition debris;

a feedstock hopper carried by the skeleton framework;

a feedstock feeder system carried by the skeleton framework and disposed beneath the feedstock hopper;

a pre-screen carried by the skeleton framework and having one end disposed next to the feed inlet opening of the crushing mechanism, the pre-screen being configured and disposed to accept feedstock from said feedstock feeder system;

a side conveyor carried by the skeleton framework and having one end disposed beneath the pre-screen;

a discharge conveyor carried by the skeleton framework and having one end disposed beneath the outlet opening of the crushing mechanism;

a magnet carried by the skeleton framework and disposed above a section of the discharge conveyor; and a screening/separator carried by the skeleton framework and disposed to receive disintegrated material from the discharge conveyor, said screening/separator having a top deck and a bottom deck;

a second side conveyor having one end disposed to receive processed material from said top deck of said screening/separator;

a third side conveyor having one end disposed to receive processed material from said bottom deck of said screening/separator;

a forward-most conveyor having one end carried under the screening/separator; and wherein the ratio of the area of the inlet opening in square feet to the overall weight of the compact mobile crushing and screening apparatus in tons is at least about 0.25.

22. A compact mobile crushing and screening apparatus as in claim 21, wherein the crushing mechanism carried by said skeleton framework has a feed inlet opening of at least about 3.5 square feet.

23. A compact mobile crushing and screening apparatus as in claim 22, wherein the weight of the overall apparatus is no more than about twenty tons (40,000 pounds).

24. A compact mobile crushing and screening apparatus as in claim 21, wherein the weight of the overall apparatus is no more than about twenty tons (40,000 pounds).

25. A compact mobile crushing and screening apparatus as in claim 21, wherein the crushing mechanism is a jaw crusher.

26. A compact mobile crushing and screening apparatus as in claim 21, wherein the crushing mechanism carried by said skeleton framework has a feed inlet opening of at least about 3.5 square feet, the weight of the overall apparatus is no more than about twenty tons (40,000 pounds) and the crushing mechanism is a jaw crusher.

* * * * *